US006868767B1

(12) United States Patent
Dunn

(10) Patent No.: US 6,868,767 B1
(45) **Date of Patent: *Mar. 22, 2005**

(54) FLEXIBLE MANUFACTURING PRESS ASSEMBLY

(76) Inventor: David C. Dunn, 410 E. Cleveland, Guthrie, OK (US) 74044

( * ) Notice: Subject to any disclaimer, the term of this patent is extended or adjusted under 35 U.S.C. 154(b) by 0 days.

This patent is subject to a terminal disclaimer.

(21) Appl. No.: 09/114,334

(22) Filed: Jul. 13, 1998

Related U.S. Application Data

(63) Continuation-in-part of application No. 08/461,140, filed on Jun. 5, 1995, now Pat. No. 5,778,749.

(51) Int. Cl.[7] ..... B26D 5/08

(52) U.S. Cl. ..... 83/549; 83/559; 83/563; 483/28

(58) Field of Search ..... 83/549, 550, 551, 83/559, 563, 552, 860; 483/28; 29/33 P

(56) References Cited

U.S. PATENT DOCUMENTS

| | | | | | |
|---|---|---|---|---|---|
| 2,163,641 | A | * | 6/1939 | Wales | 164/90 |
| 3,448,645 | A | | 6/1969 | Graf et al. | |
| 3,449,991 | A | | 6/1969 | Daniels | |
| 3,483,904 | A | * | 12/1969 | Jacumin | 144/3 |
| 3,600,998 | A | * | 8/1971 | Palmer | 83/391 |
| 3,691,887 | A | | 9/1972 | Roch | |
| 3,717,061 | A | | 2/1973 | Daniels | |
| 3,815,403 | A | | 6/1974 | Daniels | |
| 3,832,083 | A | * | 8/1974 | Dockery et al. | 408/24 |
| 3,878,773 | A | * | 4/1975 | Smit | 100/53 |
| 3,921,486 | A | | 11/1975 | Valente | |
| 4,052,919 | A | * | 10/1977 | McKissack | 183/205 |
| 4,106,183 | A | * | 8/1978 | Brolund et al. | 29/564 |
| 4,220,062 | A | | 9/1980 | Blanz | |
| 4,297,927 | A | | 11/1981 | Kuroda | |
| 4,486,941 | A | * | 12/1984 | Scott et al. | 29/568 |
| 4,503,741 | A | | 3/1985 | Hunter et al. | |
| 4,523,749 | A | * | 6/1985 | Kindgren et al. | 269/32 |
| 4,532,843 | A | * | 8/1985 | Miyama | 83/409 |
| 4,700,441 | A | * | 10/1987 | Ikeda et al. | 29/33 P |
| 4,901,427 | A | * | 2/1990 | Sakamoto et al. | 29/568 |
| 5,193,426 | A | * | 3/1993 | Dunn | 83/277 |
| 5,224,915 | A | * | 7/1993 | Kilian | 483/1 |
| 5,295,938 | A | * | 3/1994 | Jilsen | 483/29 |
| 5,350,347 | A | | 9/1994 | Fujiwara et al. | |
| 5,367,935 | A | | 11/1994 | Matsuda | |
| 5,778,749 | A | * | 7/1998 | Dunn | 83/549 |

* cited by examiner

*Primary Examiner*—Lee Young
*Assistant Examiner*—Minh Trinh
(74) *Attorney, Agent, or Firm*—Crowe & Dunlevy

(57) ABSTRACT

A flexible manufacturing press assembly for the processing of sheet material through punching and forming operations having a plurality of tool assemblies of which each, in turn, group and support a plurality of processing tools. Each tool assembly has a punch magazine, a die block, and a stripper plate for processing the sheet material in the manner of a Class A die. A sheet material positioning assembly clamps the sheet material and positions it within a two-axis plane adjacent the tool assemblies. A punching head assembly, supported by the sheet material positioning assembly, positions a punching head adjacent the grouped tool supports. A selective transmitting assembly is supported by the punching head assembly and has a selector member that is linearly positioned and is furthermore rotatable to position a selected one of a plurality of contact faces to a striking position to enable the transmitting of a punching force from the punching head assembly to one or more selected tools within one of the tool assemblies.

13 Claims, 26 Drawing Sheets

FLEXIBLE MANUFACTURING PRESS ASSEMBLY

CROSS REFERENCE TO RELATED APPLICATION

The present application is a continuation-in-part of the following United States patent application and incorporates by reference the application:

FLEXIBLE MANUFACTURING PRESS ASSEMBLY, Ser. No. 08/461,140, filed Jun. 5, 1995, now U.S. Pat. No. 5,778,749.

BACKGROUND OF THE INVENTION

1. Field of the Invention

The present invention relates to the field of fabrication equipment, and more particularly but not by way of limitation, to an improved linear press assembly having flexible manufacturing capabilities for processing sheet material.

2. Discussion

Soft-tooling methods of manufacturing,and more particularly that of processing sheet metal by punching and forming operations, are well known and widely used in the metal fabrication industry. Soft-tooling methods refer generally to manufacturing processes utilizing non-dedicated tooling. Conversely, hard-tooling methods generally involve processes utilizing tooling that is built for a particular part or grouping of similar parts. Although hard-tooling methods provide superior cycle-time efficiency because the press typically punches only one time for each part produced, the changeover time and inflexibility of hard-tooling limits its use to production schemes employing large batch sizes. Modern production demands for flexibility, just-in-time delivery, and near 100% utilization of all valve-added resources justify the use of soft-tooled manufacturing methods.

Computer numerically controlled (CNC) punch presses are commonly used in soft-tooling methods, wherein individual tools are used in designated punch hit and sheet material positioning schemes to produce a wide variety of different parts. CNC presses require only a fraction of the changeover time from one part to the next as compared to hard-tooled die methods. CNC presses furthermore offer savings in initial tool investment as the individual tools may be used in limitless combinations to produce a wide variety of different parts without dedicating any tooling to a particular part. Forming operations in addition to punching operations are common in CNC presses, where bullet punches and louver and embossment sections are commonly used to that end. Even when hard-tooling methods are used as the primary manufacturing method it is customary to have in place alternative soft-tooled methods as a backup.

CNC presses permit a minimal outlay in tooling expenditures because a fixed number of tools can be used to make any desired part. This is achieved by using a punch with multiple material repositionings to nibble uncommon features or profiles. Nibbling also reduces changeover time in the part production sequence by eliminating tool changeouts between parts.

Parts nesting, too, is a common practice which provides the ability to make different parts out of a common blank. Typically this is done where different parts are needed in downstream operations such as a subassembly operation. Shaker tabs are commonly formed between the parts so that the processed blank can be removed intact, and the parts can be easily separated thereafter. The diversity offered by CNC press technology provides the ability to pick and choose which parts to run together and typically involves a simple interaction between the operator and the press to download the individual part computer programs into a combined nested program.

Flexible manufacturing methods such as those of a CNC press best support a just-in-time manufacturing approach to scheduling production. CNC presses are more conducive to diverse varieties and short lot runs in comparison to large bed punch presses. The dynamics of flexibility and just-in-time scheduling have created an increased demand for soft-tooled manufacturing methods and will continue to drive the development of improvements in the art.

The prior art CNC presses typically employ a bridge-type frame supporting a sheet material delivery system in communication with a tool delivery system. The sheet material delivery system responds to programmed instructions to move the sheet material within a two-axis plane to deliver that portion to be processed to a punch location. Simultaneously, the tool delivery system delivers the selected punch and matingly aligned die to the punch location. A punching force is then delivered to drive the punch through (or against if forming) the sheet material which is supported by the die. Well known limitations of existing CNC presses include limited tool storage capacity, cumbersome tool change-outs, the expense of specialty tooling,and the inability to use more than one tool at a time.

The earliest solutions in the art are represented by the turret type punch press, as is taught in U.S. Pat. Nos. 3,449,991 and 3,717,061 issued to Daniels. The turret press uses a rotary turret to hold the tools. The turret responds to programmed instructions to rotate and position the selected tool relative to a punching head. One disadvantage of the turret press is the limited number of tools that can be stored in a turret, which ranges from about twenty to sixty tools. Another disadvantage of the turret press is that each individual punch and die must be maintained in alignment as the turret is rotated. Misalignment causes premature tool wear and sometimes catastrophic tool failure.

An alternative prior art approach is the cartridge type punch press, as is taught in U.S. Pat. No. 4,503,741 issued to Hunter. This cartridge press uses one or more pairs of mating cartridge tool holders. The cartridge pairs are moved to deliver the selected tool within a cartridge to the punching head. Although the cartridges offer improvements in tool delivery, disadvantages such as tool alignment problems and limited tool capacity are not resolved.

World class manufacturing methods and the business practices that drive them unquestionably will continue to emphasize maximizing part velocity through the manufacturing process. The era of building large in-process inventories has effectively been replaced by the practice of producing small batch quantities of in-process material and delivering them just-in-time for use. Cellular manufacturing approaches operating in accordance to regimented scheduling schemes provide the flexibility and part velocity meets today's demand for near 100% utilization of all value-added processing centers in an organization.

The demand for faster presses that are capable of more operations with larger tool holding capacities and of simpler mechanical design will foster revolutionary improvements in the field of material processing. There is a long-felt need in the industry for a press that provides the best of both worlds, the operating efficiency of hard-tooled methods with the flexibility of soft-tooled methods.

SUMMARY OF THE INVENTION

The present invention provides a press assembly for punching,forming,and braking operations on sheet material, such as for sheet metal part manufacture. The press assembly has a central frame assembly which supports a plurality of removable tool assemblies of which each, in turn, group and support a plurality of processing tools. The tool assembly, also referred to as the grouping support assembly, comprises a punch magazine containing punches, a stripper block containing stripper dies, and a die block containing punch dies. One skilled in the art will recognize the punch magazine, stripper block, and die block operate in the same manner as a Class A hard-tooled die.

Each tool assembly is supported by the central frame assembly so that each punch remains at all times coaxial with its matingly aligned stripper die and punch die during processing of the sheet material. Tool assemblies not being used are recessed to maximize the clearance between the punch magazine and die block for clear passage of the sheet material being processed.

A two-axis sheet material positioning assembly grips the sheet material and it to positions adjacent the desired tool assembly. The sheet material positioning assembly has a plurality of clamps providing adjustable grip pressure to allow adequate clamping over a wide range of sheet material thicknesses without damage to the sheet material.

A punching head assembly is slidingly supported by the sheet material positioning assembly to position a punching head adjacent the desired punch magazine. A die block lift assembly is supported by the central frame and is positionable adjacent the desired die block. The punching head assembly and die block lift assembly operably engage the desired punch magazine and die block, respectively. The punching head assembly thereafter imparts a reciprocating force to engage the punch against the die with the sheet material therebetween.

A selector assembly is supported by the punching head assembly and has a selector member that is positioned adjacent selected punches of the desired punch magazine to selectively transmit the reciprocating force of the punching head assembly to the selected punches. The selector member has a plurality of characteristic faces and is rotatable to position any of the faces adjacent the selected punches to determine which punch or punches are impacted by the reciprocating force.

An object of the present invention is to provide a press assembly which performs common metal working operations in a novel, improved manner.

A further object of the present invention, while achieving the above stated object, is to provide a press assembly which is capable of storing and using a larger number of punch and die sets for performing punching,forming,and braking operations on sheet material.

Another object of the present invention, while achieving the above stated objects, is to provide a press assembly that is more economical to tool in terms of initial tool investment and tooling maintenance expense.

One other object of the present invention, while achieving the above stated objects, is to provide a press assembly that reduces the number of tooling changeovers necessary to support the manufacture of a diverse variety of parts.

A further object of the present invention, while achieving the above stated objects, is to provide a press assembly that produces parts with fewer tool hits, thereby providing faster batch velocity through the manufacturing process.

Other objects, features, and advantages of the present invention will become apparent from the following description when read in conjunction with the drawings and claims.

DESCRIPTION

Figure 1:
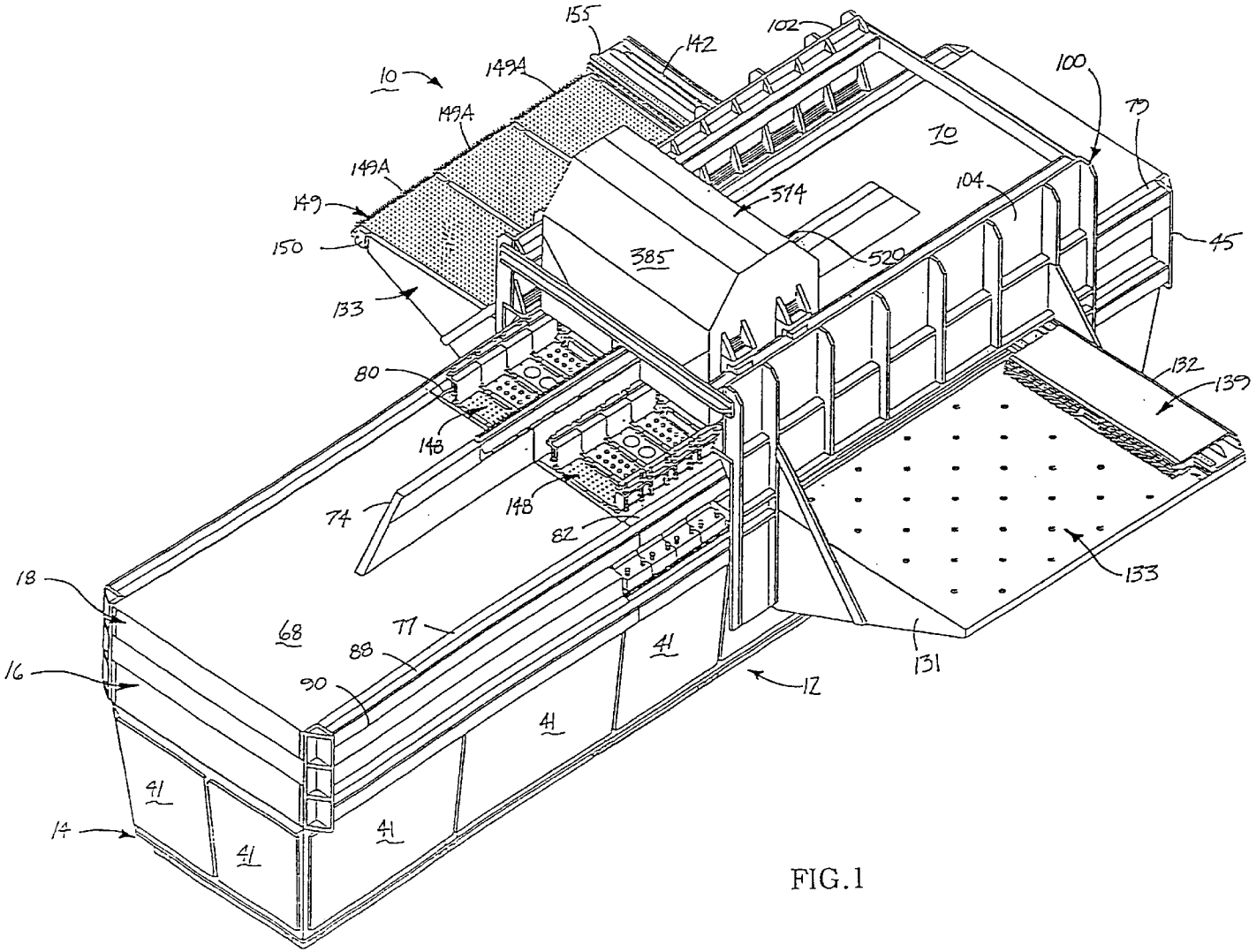
FIG. 1 is an isometric view of a press assembly constructed in accordance with the present invention.

Referring now to the drawings and to FIG. 1 in particular, shown therein is a press assembly 10 constructed in accordance with the present invention. The press assembly 10 has a supporting central frame assembly 12 which, in turn, has a base framework 14, a bolster frame 16, and a magazine support frame 18.

Figure 2:
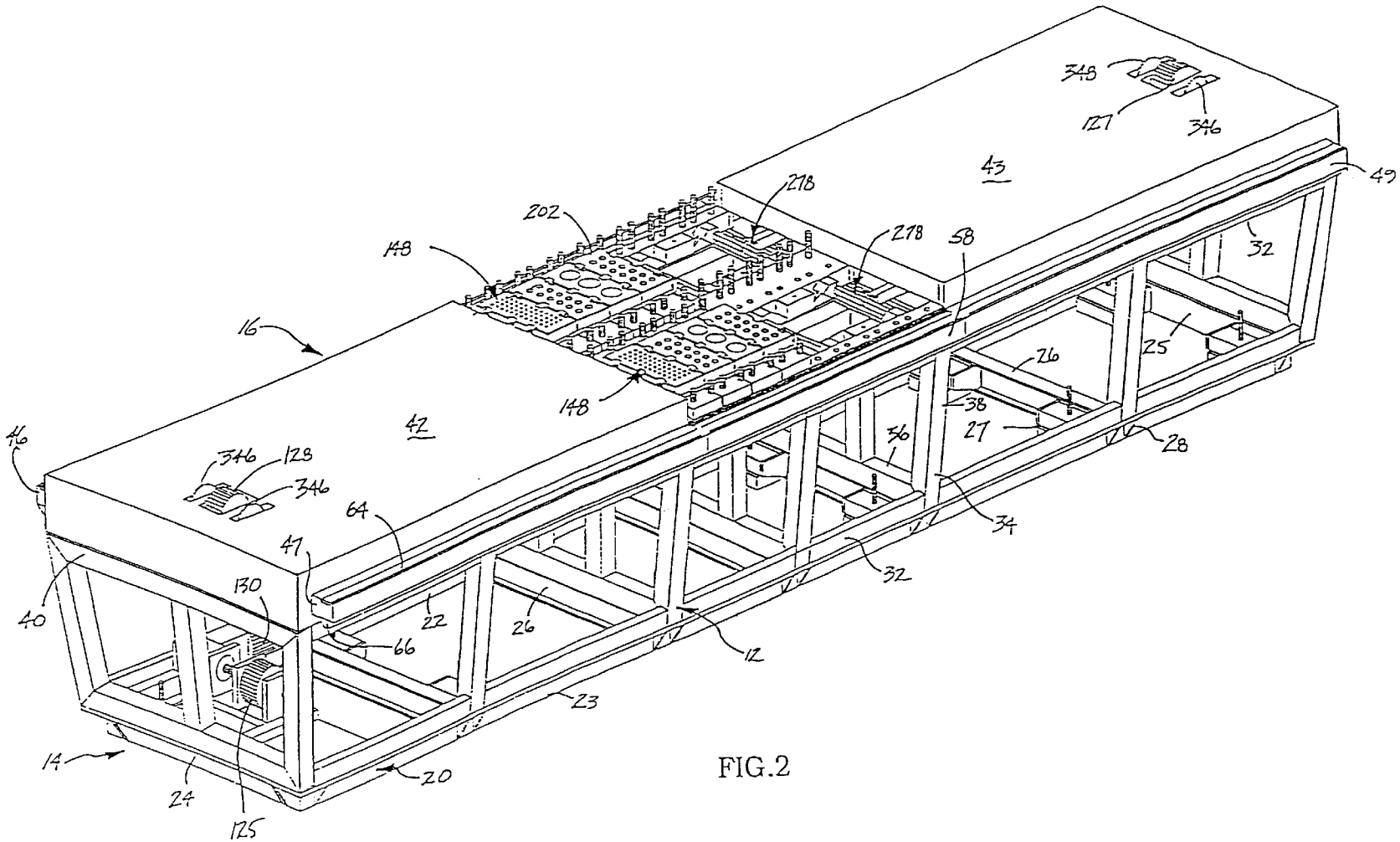
FIG. 2 is an isometric view of a portion of the press assembly of FIG. 1 showing the base framework supporting the bolster frame which, in turn, supports the plurality of die blocks.

Turning to FIG. 2, shown therein is the base framework 14 which is constructed of structural steel components joined and welded in a conventional manner. The base framework 14 has a base frame 20 which is constructed by the joining of opposing parallel side members 22, 23 to opposing parallel end members 24, 25. A plurality of cross members 26, intermediate the end members 24, 25 and essentially perpendicularly joined to the side members 22, 23, provide the necessary rigidity to the base frame 20. A number of isolator mounts 27 are attached to the base frame 20 to provide for leveling and for absorbing vibration during operation of the press assembly 10.

FIG. 2 illustrates the use of angle-iron for the side members 22, 23 and end members 24, 25 with a plurality of gussets 28 attached thereto for stiffening. Clearly, other well known construction embodiments are equivalent such as the use of square tubing or I-beams.

A number of horizontal support members 32 and vertical support members 34 are joined to each other and to the base frame 20. Horizontal intermediate support members 36 and vertical intermediate support members 38 are similarly joined to each other and to the cross members 26 to further provide the necessary rigidity to the base framework 14. The vertical support members 34 and the vertical intermediate support members 38 are attached to a number of horizontal upper support members 40. FIG. 1 shows a plurality of cover panels 41 attached to the base framework 14 to cover the openings formed between the vertical support members 34, horizontal support members 32, and the horizontal upper support members 40.

As illustrated in FIG. 2, square tubing is used to construct the vertical support members 34, vertical intermediate support members 38, and horizontal upper support members 40, and angle-iron is used to construct the horizontal support members 32. Clearly, various types of structural steel such as C-channel or I-beam are equivalent to that illustrated.

Figure 3:
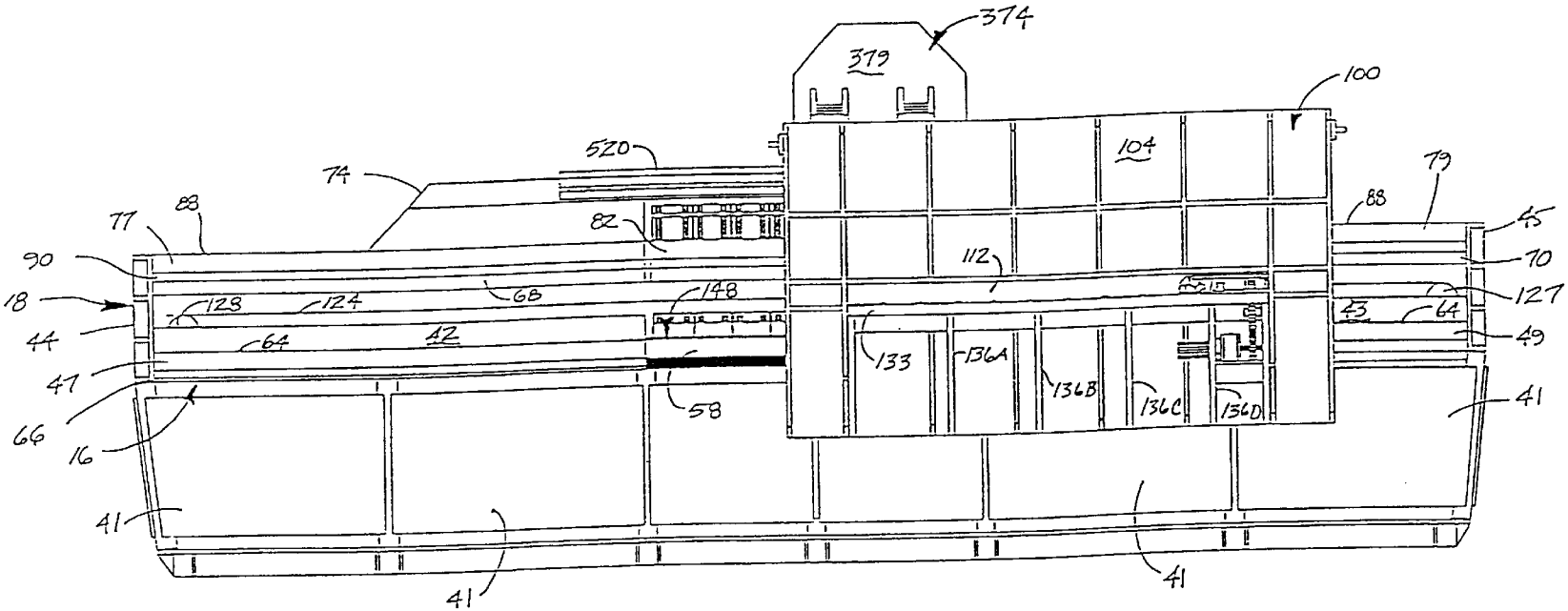
FIG. 3 is a side elevational view of the press assembly of FIG. 1, showing the sheet material loading side of the press assembly.

FIG. 2 further shows the bolster frame 16 which has a first lower support member 42 and a second lower support member 43 that are constructed of welded plate steel with stiffening members underneath to provide sufficient strength, rigidity, and flatness. FIG. 3 shows a first end member 44 is supported by the first lower support member 42 which, in turn, is supported by the base framework 14. A second end member 45 is supported by the second lower support member 43 which, in turn, is likewise supported by the base framework 14. A gap is formed between the first and second lower support members 42, 43 for accommodating groups of processing tools which will be described hereinbelow.

Figure 5:
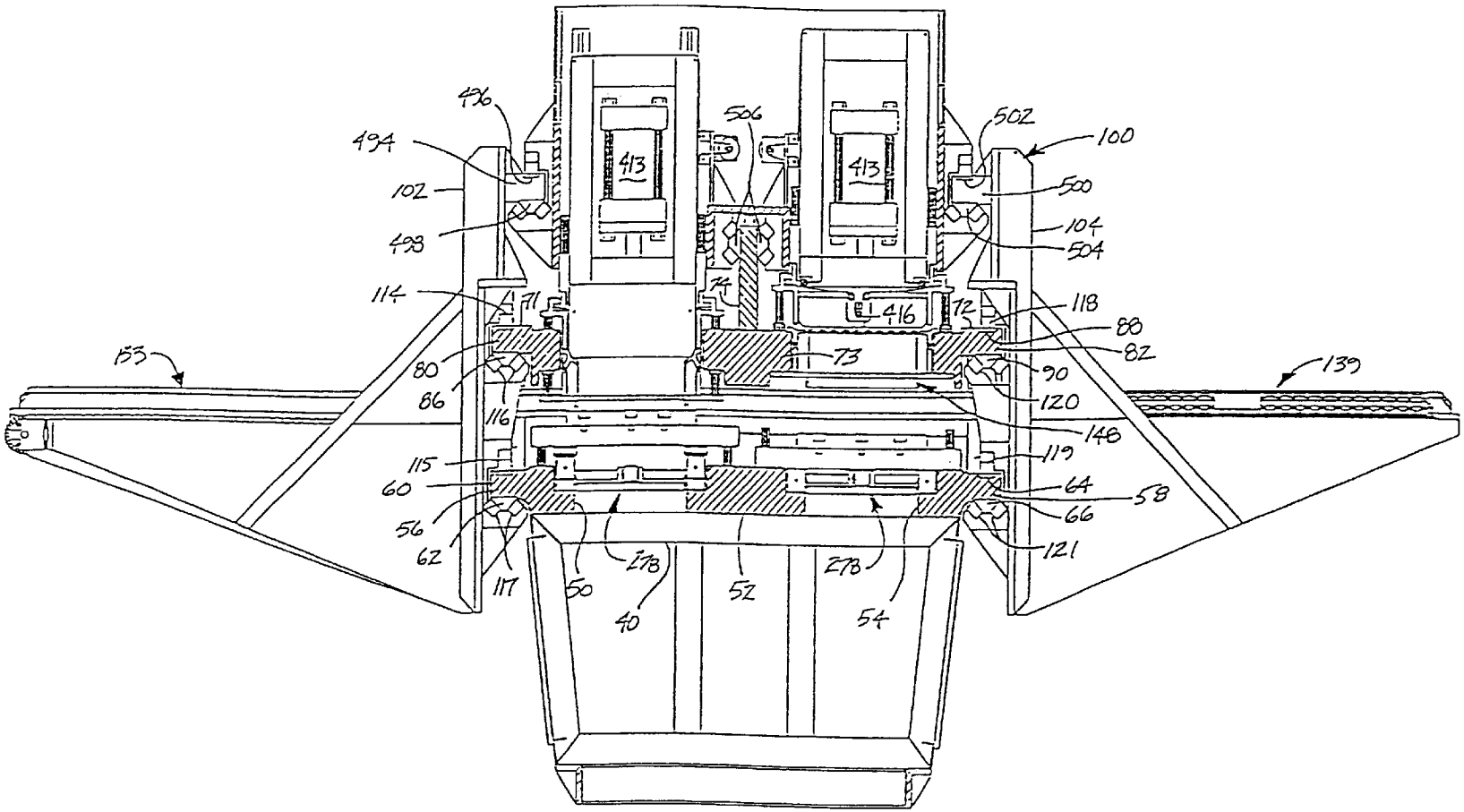
FIG. 5 is a sectional view taken generally along the line 5—5 of FIG. 4.

Returning to FIG. 2, it will be noted that a pair of first die frame supports 46, 47 are attached on opposing sides of the first lower support member 42. A pair of second die frame supports 48 (see FIG. 8), 49 are attached on opposing sides of the second lower support member 43. FIG. 5 shows a left-hand die lifter support 50, a central die lifter support 52, and a right-hand die lifter support 54 which are supported by the base framework 14 and contiguous to the first and second lower support members 42, 43. The left-hand die lifter support 50 and the right-hand die lifter support 54 form intermediate die frame support portions 56, 58 which are contiguous with the pair of first die frame supports 46, 47 and the pair of second die frame supports 48, 49.

Figure 8:
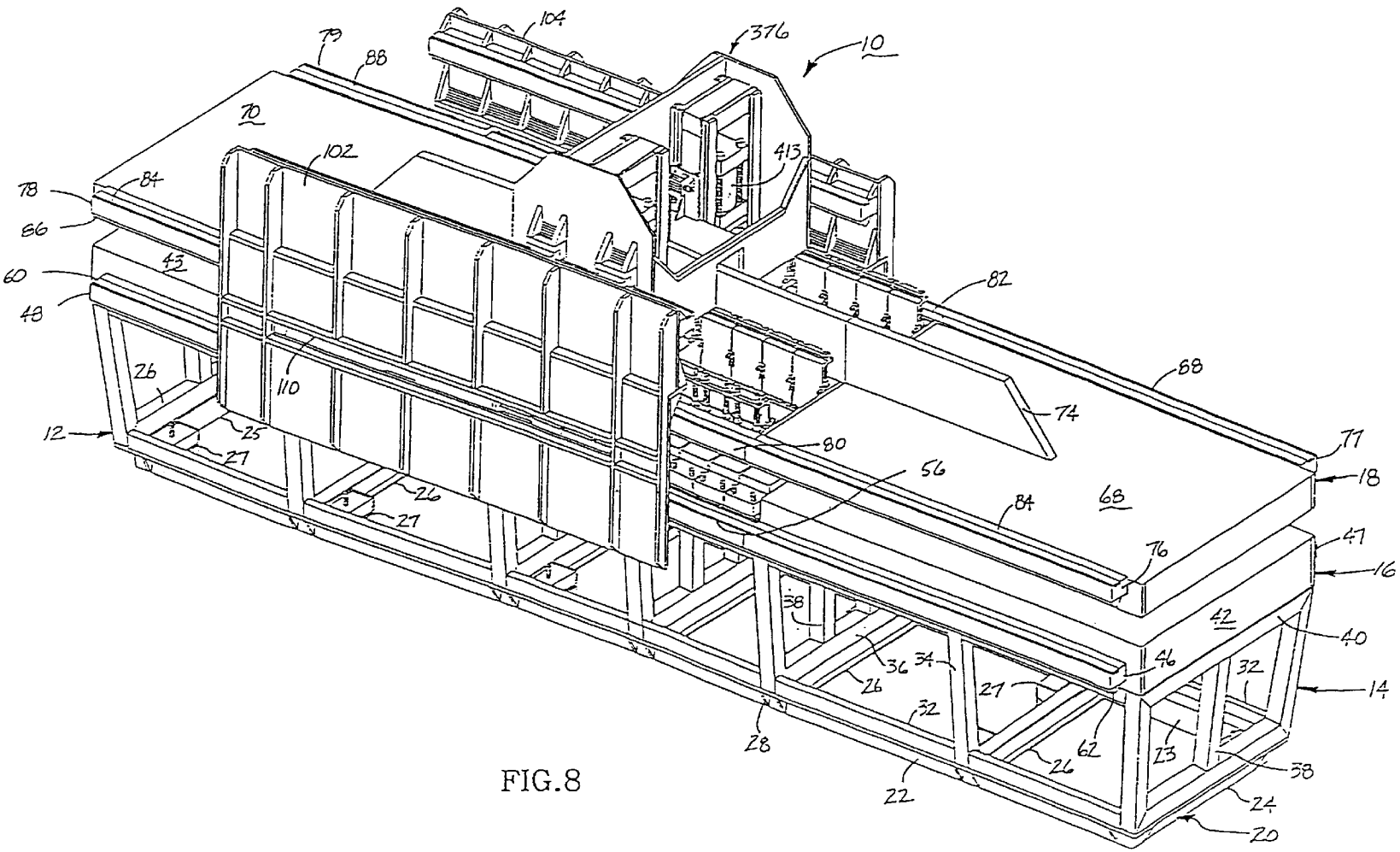
FIG. 8 is an isometric, partially cutaway view of the press assembly of FIG. 1 less the unloader conveyor assembly, the end support members, and the punching assembly cover.

Turning now to FIG. 8, shown therein is a top guide rail 60 and a bottom guide rail 62 supported by the cooperating first die frame support 46, intermediate die frame support portion 56, and second die frame support 48. In like manner, FIG. 2 shows an opposing top guide rail 64 and a bottom guide rail 66 supported by the cooperating first die frame support 47, intermediate die frame support portion 58, and second die frame support 49.

In the manner described hereinabove, the bolster frame 16 is supported by the base framework 14 and has first and second lower support members 42, 43 and left-hand, central, and right-hand die lifter supports 50, 52, 54 which cooperatively support opposing top guide rails 60, 64 and opposing bottom guide rails 62, 66.

Figure 7:
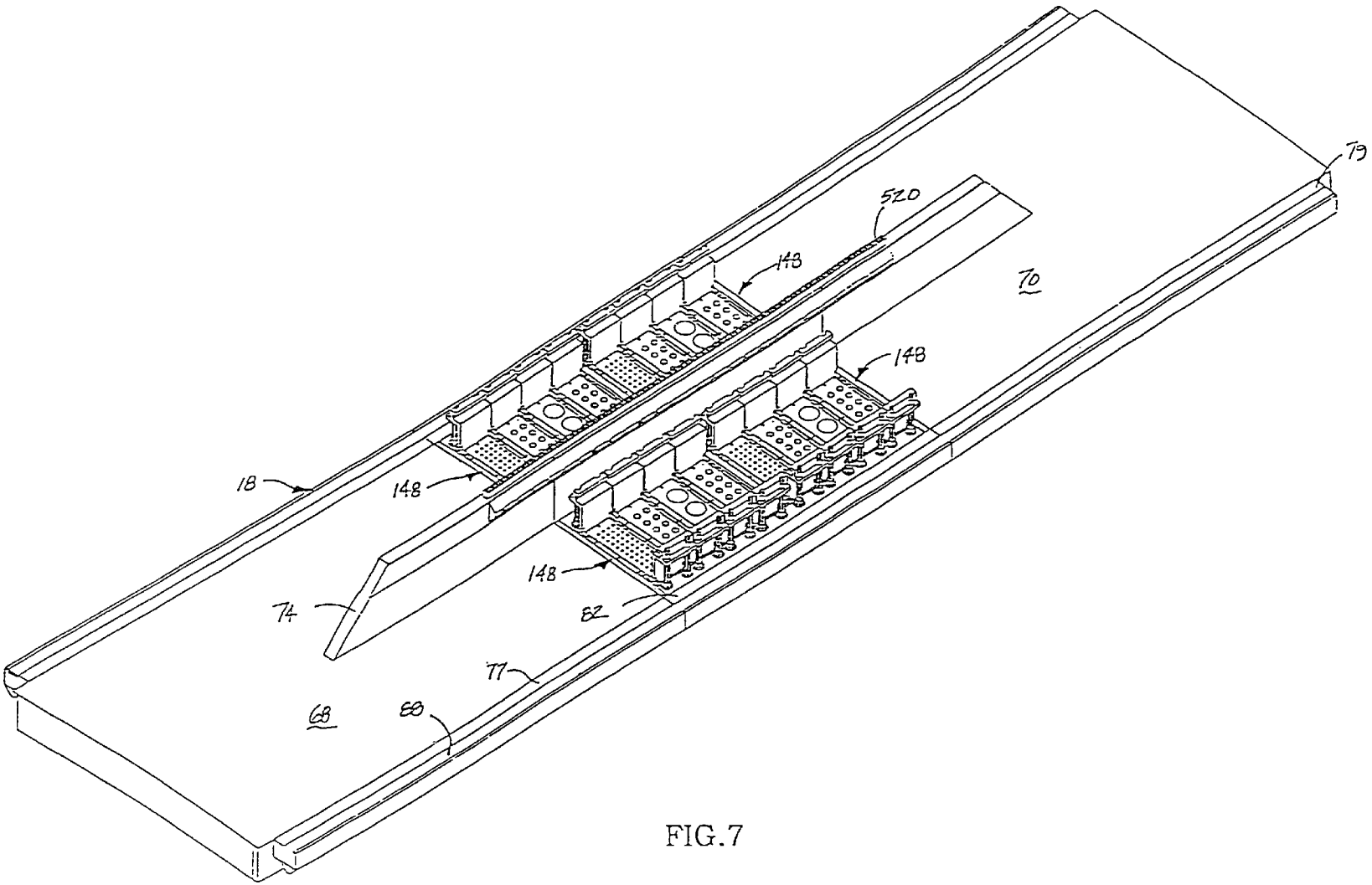
FIG. 7 is an isometric view of a portion of the press assembly of FIG. 1, showing the magazine support frame supporting the plurality of punch magazines.

Turning to FIG. 7, shown therein is the magazine support frame 18 which has a first upper support member 68 and a second upper support member 70, both constructed of welded plate steel with stiffening members underneath to provide sufficient strength, rigidity, and flatness. As shown in FIG. 3, the first upper support member 68 is supported by the first end member 44 and disposed in spatial parallel relation to the first lower support member 42. The second upper support member 70 is supported by the second end member 45 and disposed in spatial parallel relation to the second lower support member 43. A gap is formed between the first and second upper support members 68, 70 for accommodating groups of processing tools which will be described hereinbelow.

FIG. 5 shows a left-hand magazine bridge member 71, a right-hand magazine bridge member 72, and a central magazine bridge member 73. The left-hand, right-hand, and central magazine bridge members 71, 72, 73 are contiguous with the first upper support member 68 and the second upper support member 70. In this manner, the left-hand, right-hand, and central magazine bridge members 71, 72, 73 bridge the gap formed between the first and second upper support members 68, 70. A bridge beam 74 is attached to the first upper support member 68, to the central magazine bridge member 73, and to the second upper support member 70, to provide strength and rigidity to the magazine support frame 18.

Returning to FIG. 8, shown therein is a pair of first punch frame supports 76, 77 which are attached to opposing sides of the first upper support member 68. A pair of second punch frame supports 78, 79 are attached to opposing sides of the second upper support member 70. The left-hand magazine bridge member 71 (see FIG. 5) and the right-hand magazine bridge member 72 (see FIG. 5) form intermediate punch frame supports 80, 82 which are contiguous with the first punch frame supports 76, 77 and the second punch frame supports 78, 79, respectively.

A top guide rail 84 and a bottom guide rail 86 are supported by the coextensive first punch frame support 76, intermediate punch frame support 80, and second punch frame support 78. Similarly, FIG. 1 shows a top guide rail 88 and a bottom guide rail 90 are supported by the coextensive first punch frame support 77, intermediate punch frame support 82, and second punch frame support 79.

In the manner described hereinabove, the magazine support frame 18 is supported by the first and second end members 44, 45 and the spanning bridge beam 74, and has first and second upper support members 68, 70 and contiguous left-hand, right-hand, and central magazine bridge members 71, 72, 73 which cooperatively support opposing top guide rails 84, 88 and opposing bottom guide rails 86, 90.

The central frame assembly 12 includes the magazine support frame 18 and the bolster frame 16 which operably support grouped tooling assemblies, punching head assemblies, and a sheet material positioning assembly to be described below. Clearly, other well known press frame construction embodiments, such as a bridge-type frame or a C-frame, are equivalent alternatives to that described hereinabove.

Figure 4:
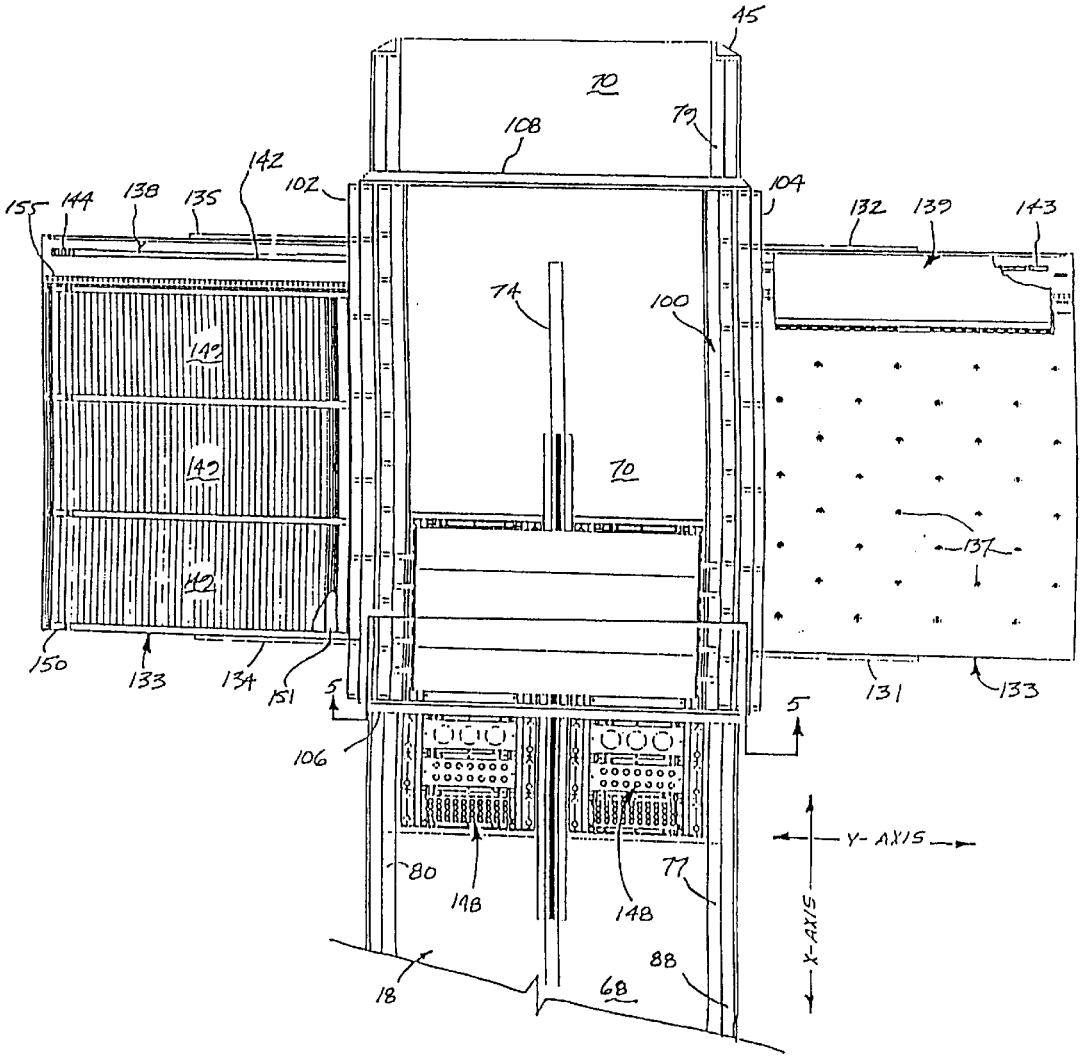
FIG. 4 is a partially cutaway top plan view of the press assembly of FIG. 1, the sheet material clamp assembly in a loading position.

Turning now to FIG. 4, shown therein is an x-axis frame assembly 100 which is slidingly supported for longitudinal displacement along the bolster frame 16. The x-axis frame assembly 100 has opposing parallel side frame members 102, 104 that are supported by a front cross member 106 and a rear cross member 108. The side frame members 102, 104 form opposing rectangular side frame openings 110 (see FIG. 8) and 112 (see FIG. 3).

As shown in FIG. 5, the side frame member 102 supports upper linear bearings 114, 115 and furthermore supports pairs of lower linear bearings 116, 117. In like manner, the side frame member 104 supports upper linear bearings 118, 119 and furthermore supports pairs of lower linear bearings 120, 121. The x-axis frame assembly 100 is thereby supported for longitudinal x-axis displacement by the bolster frame 16. The upper linear bearings 115, 119 engage the top guide rails 60, 64, and the pairs of lower linear bearings 117, 121 engage the bottom guide rails 62, 66.

Figure 9:
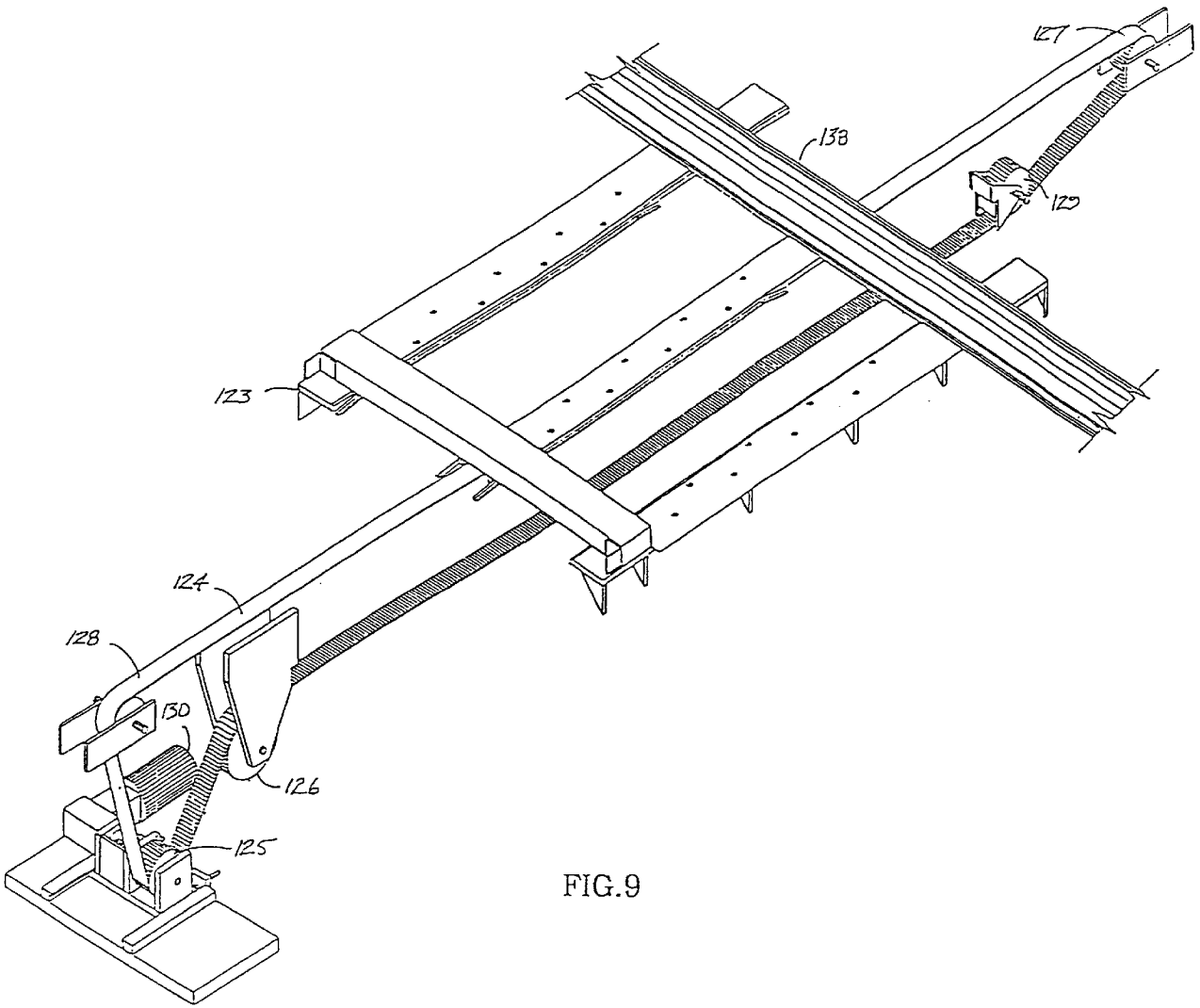
FIG. 9 is an isometric view of the drive mechanism for the x-axis frame assembly.

FIG. 9 shows the drive assembly for the x-axis frame assembly 100. A frame 123 is attached to the x-axis frame assembly 100 (not shown) and to a belt 124. The belt 124 is trained around a driving pulley 125 and a plurality of idler pulleys 126, 127, 128, 129. A motor 130 provides power to the driving pulley 125. The motor 130 and driving pulley 125 are supported by the base framework 14 (see FIG. 20). The idler pulleys 126, 127, 128, 129 are supported by the bolster frame 16 (see FIG. 20).

It will be understood that a conventional closed loop CNC system is used to control the operation and sequence of the press assembly 10. The construction, programming and operation of the CNC system is well known and understood by one skilled in the art. It will be noted here that the position of the x-axis frame assembly 100 is maintained by a linear scale attached to the bolster frame 16 which provides feedback to the CNC system.

As shown in FIG. 4, gusset members 131, 132 depend from the side frame member 104 and support a first end of a sheet material support table 133. Similarly, gusset members 134, 135 depend from the side frame member 102 and support a distal end of the sheet material support table 133. Both the first end and the distal end of the sheet material support table 133 have additional supports intermediate the gusset members 131, 132 and 134, 135 provided by a number of intermediate gusset members 136A, 136B, 136C, and 136D, shown on one side in FIG. 3.

FIG. 4 shows a plurality of roller bearings 137 disposed in the sheet material support table 133 which engage the sheet material during processing. The sheet material support table 133 supports a cross slide 138. A sheet material clamp assembly 139 is slidingly supported by the cross slide 138 for y-axis linear displacement.

Figure 10:
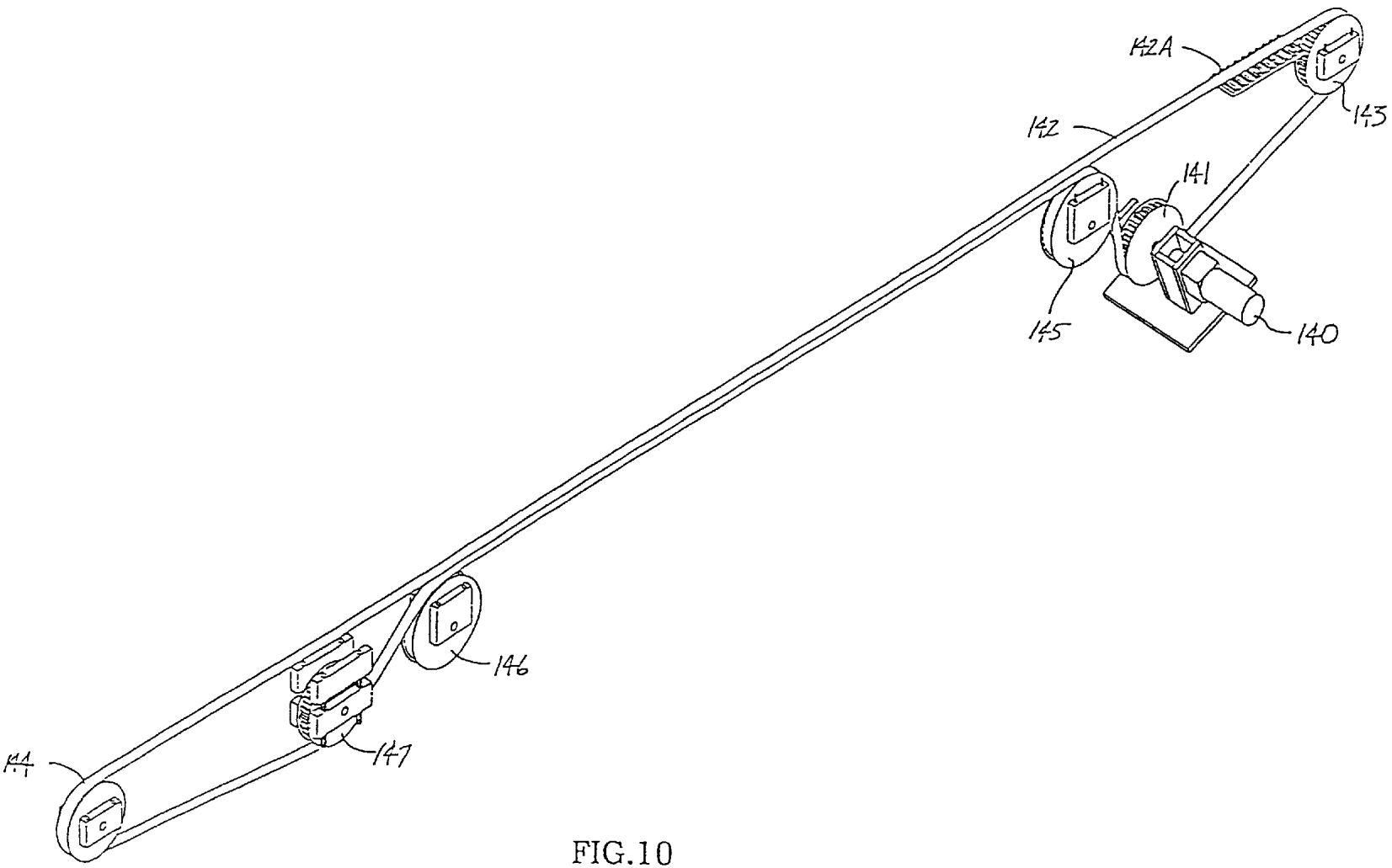
FIG. 10 is an isometric view of the positioning mechanism for y-axis displacement of the sheet material clamp assembly.

The sheet material clamp assembly 139 is positioned along the cross slide 138 by a drive assembly shown in FIG. 10. A motor 140 engages a driving pulley 141 which thereby communicates displacement to a belt 142 which is trained around a first end pulley 143 and a distal end pulley 144 which are supported by the cross slide 138 (not shown). The belt 142 engages a plurality of idler pulleys 145, 146 and a tensioner pulley 147. The belt 142 is attached to the sheet material clamp assembly 139 by a belt clamp 142A. The position of the sheet material clamp assembly 139 is maintained by a linear scale which provides feedback to the closed loop CNC system (not shown).

The sheet material clamp assembly 139 grips the sheet material being processed and positions the sheet material to desired locations along the y-axis direction of travel. The extended portion of the sheet material, beyond that portion clamped, is supported upon the plurality of roller bearings 137 to prevent damage to the sheet material during movement.

The press assembly 10 has a sheet material loading position, shown in FIG. 4, where the x-axis frame assembly 100 is positioned at an x-axis zero reference position and the sheet material clamp assembly 139 is positioned at a y-axis zero reference position. In this position of the sheet material clamp assembly 139 an operator is able to clamp a sheet of sheet material for processing. During the programmed sheet material move sequences that follow during processing of the sheet material the x-axis frame assembly 100 moves the sheet material to determined locations along the x-axis direction of travel and the sheet material clamp assembly 139 moves the sheet material to determined locations along the y-axis direction of travel. In this manner the x-axis frame assembly 100 and the sheet material clamp assembly 139 cooperatively position the sheet material to determined positions relative to a desired tool assembly 148 which groupingly supports a plurality of processing tools.

Figure 11:
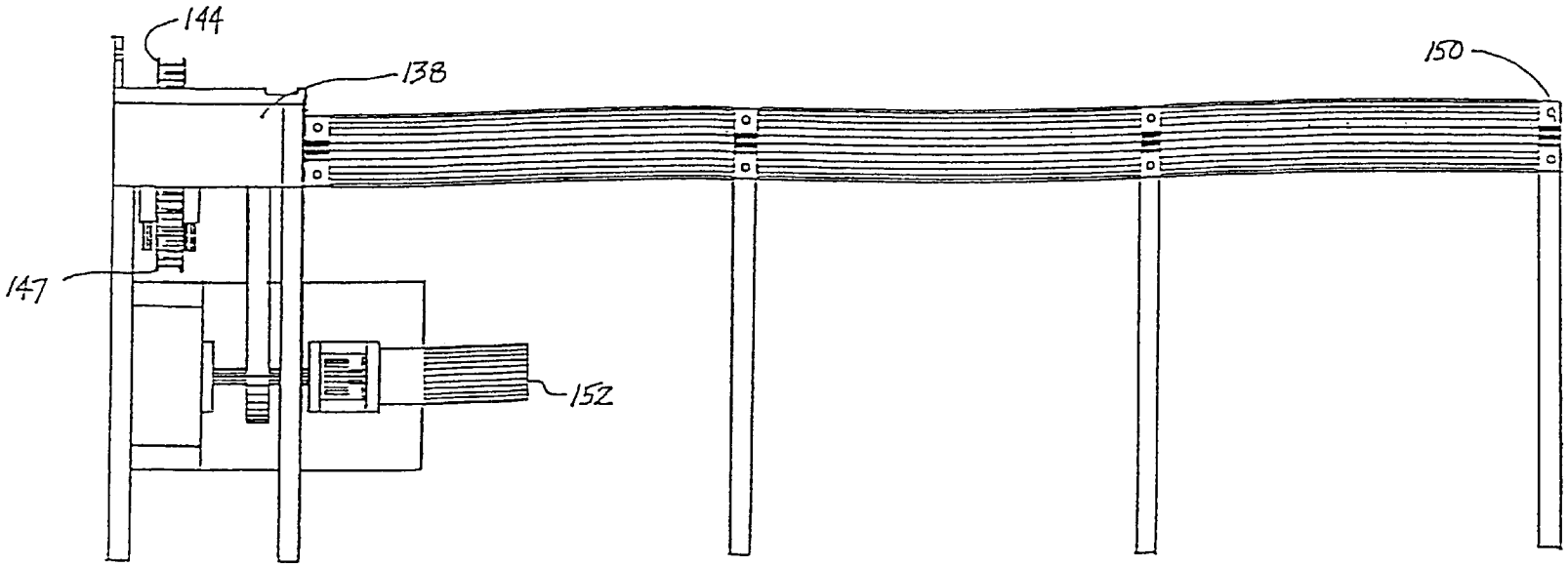
FIG. 11 is a side elevational view of the drive mechanism for the sheet material unloading conveyors.

When the programmed sequence of operations on the sheet material is complete, the x-axis frame assembly 100 and the sheet material clamp assembly 139 cooperatively move the sheet material to a sheet material unloading position. In the sheet material unloading position the extended portion of the sheet material, beyond that portion clamped, is positioned over an unloader conveyor assembly 149. Unloader belts 149A form continuous loops around a free wheeling outboard shaft 150 and a powered inboard shaft 151 which is driven by a motor 152 (see FIG. 11). The powered inboard shaft 151 is activated when the press assembly 10 moves to the sheet material unloading position and the sheet material clamp assembly 139 releases the grip on the sheet material allowing the rotating unloader conveyor assembly 149 to unload the sheet material to an appropriately positioned stack bin or scissor lift table. The sheet material clamp assembly 139, having unloaded the processed sheet material, returns to the loading position to receive the next sheet of material for processing.

Figure 13:
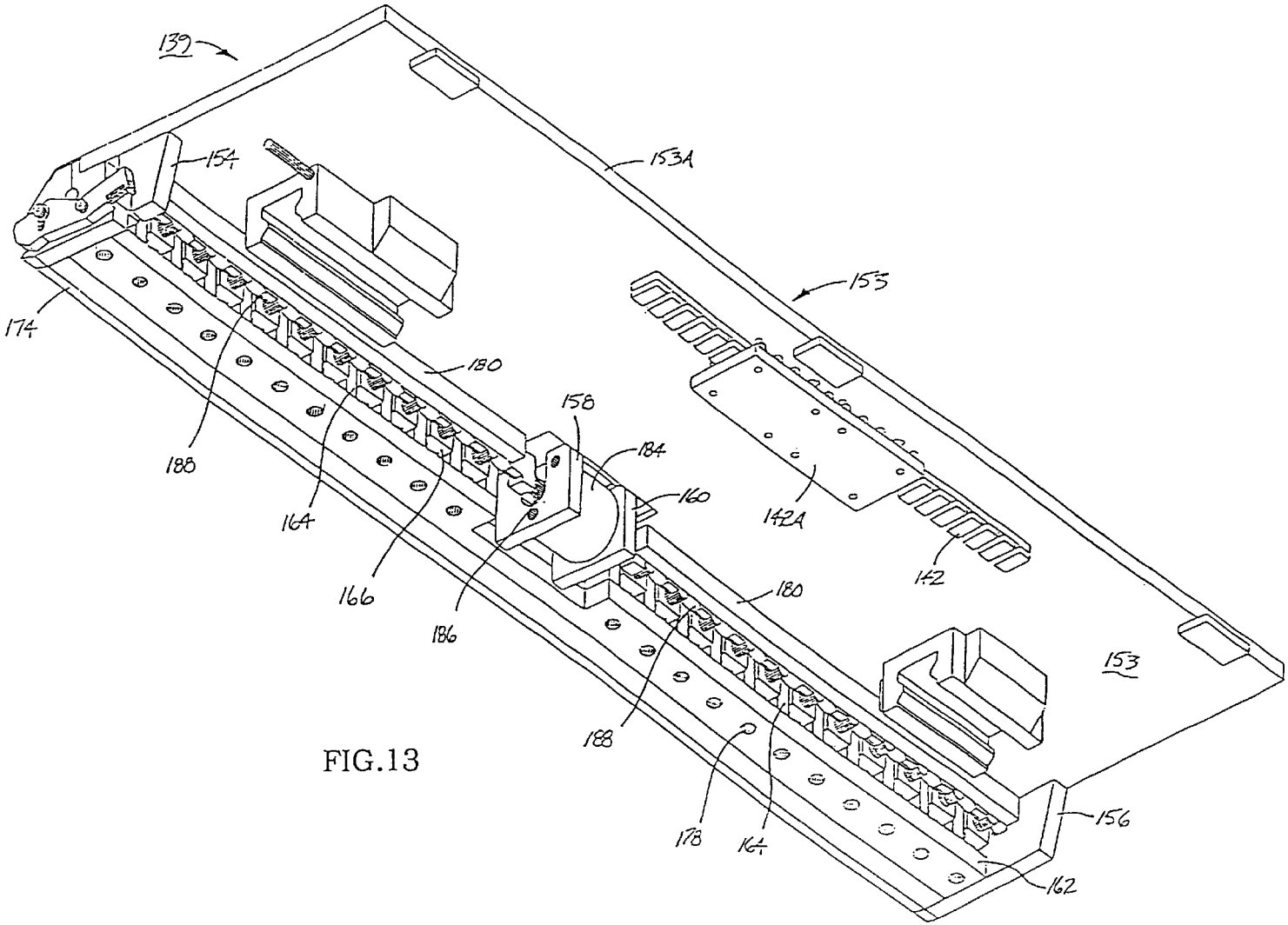
FIG. 13 is an isometric bottom view of the sheet material clamp assembly.

FIG. 13 shows a view of the underside of the sheet material clamp assembly 139. It will be understood that a clamp frame 153 has a top plate 153A supporting depending end plates 154, 156 and cylinder supports 158, 160. A bottom plate 162 is attached at a first end to the end plate 154 and at a distal end to the end plate 156. The bottom plate 162 is spatially disposed below and is parallel to the top plate 153A. A plurality of vertical risers 164 are disposed between the bottom plate 162 and the top plate 153A.

Cavities are formed between the risers 164 for receiving therein a plurality of rocker arms 166. Each rocker arm 166 is pinned to the adjacent pair of risers 164 to enable a rocking motion which provides a clamped and an unclamped position, as shown in FIG. 14 and FIG. 14A respectively.

Each rocker arm 166 forms a central body portion 168 which supports a clamp portion 170 and an opposing cam follower 172. The rocker arm 166 is supported by a pin 173 which engages adjacent risers 164 to provide for the rocking motion of the rocker arm 166.

Figure 14:
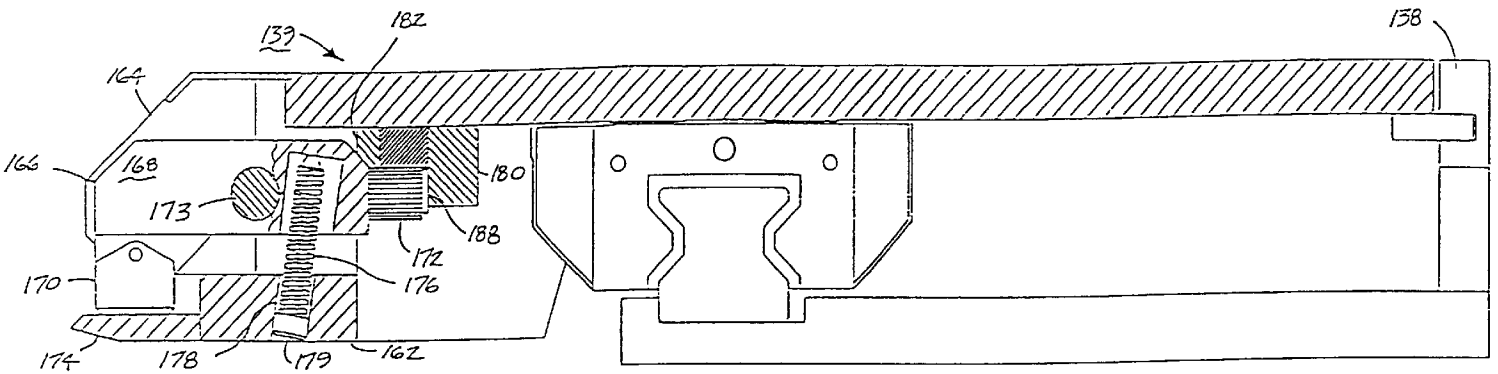
FIG. 14 and FIG. 14A are sectional views of the sheet material clamp assembly of FIG. 13.
Figure 14A:
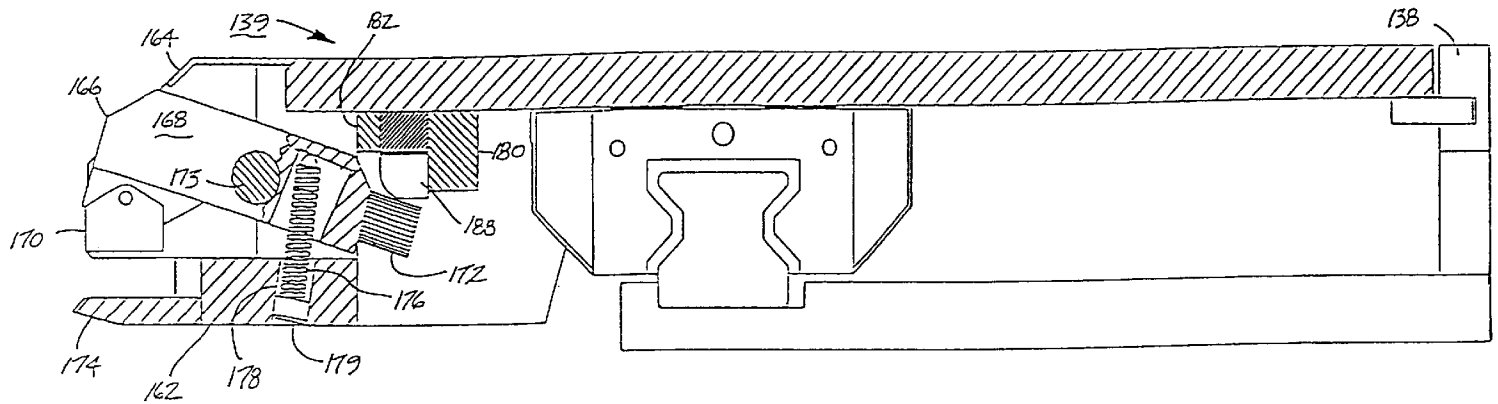

FIG. 14 shows the clamped position wherein the clamp portion 170 approaches a lower jaw member 174. The sheet material is gripped between the clamp portion 170 and the lower jaw member 174 in the clamped position. The rocker arm 166 is normally biased to the clamped position by a compression spring 176 located opposite the clamp portion 170 relative to the pin 173. The compression spring 176 is supported in pressing engagement against the rocker arm 166 by a stop 179 which is threadingly engaged within an aperture 178. The compressive force imparted by the compression spring 176 is determined by the depth of engagement of the stop 179 within the aperture 178. Progressive advancement of the stop 179 into the aperture 178 progressively increases the compressive force of the compression spring 176 against the rocker arm 166. This upward force on the rocker arm 166 imparts a counter-acting downward force on the clamp portion 170.

Returning to FIG. 13, a pair of opposing cam supports 180, 182 are supported by the top plate 153A and the end plates 154, 156. It will be noted an extensible cylinder 184 having an axial double acting shaft 186 supports a cam 188. The cam 188 forms an arcuate portion adjacent the cam follower 172. In the clamped position the cam 188 does not engage the rocker arm 166 because the arcuate portion is substantially relieved to provide clearance between the cam follower 172 and the arcuate portion of the cam 188. When the extensible cylinder 184 is activated, the cam 188 is linearly displaced. As the cam 188 is linearly displaced, the arcuate portions approach and then engage the cam follower 172. Continued displacement of the cam 188 imparts a generally downward force on the cam follower 172 in opposition to the upward force of the compression spring 176. At the limit of cam 188 travel, the downward force of the cam 188 against the cam follower 172 exceeds the upward force of the compression spring 176. The rocker arm 166 thereby rotates about the pin 173 and raises the clamp portion 170. In this manner the rocker arm 166 is moved from the clamped to the unclamped position, as illustrated in FIG. 14.

The sheet material clamp assembly 139 described hereinabove is a novel improvement in the art because a wide variation of sheet material thicknesses can be clamped without damaging the sheet material. The stop 179 can be adjusted to increase or decrease the clamping force on the sheet material. Conventional sheet material clamps typically employ a cylinder-activated jaw which clamps the sheet material with a constant pressure regardless of sheet material thickness.

Figure 12:
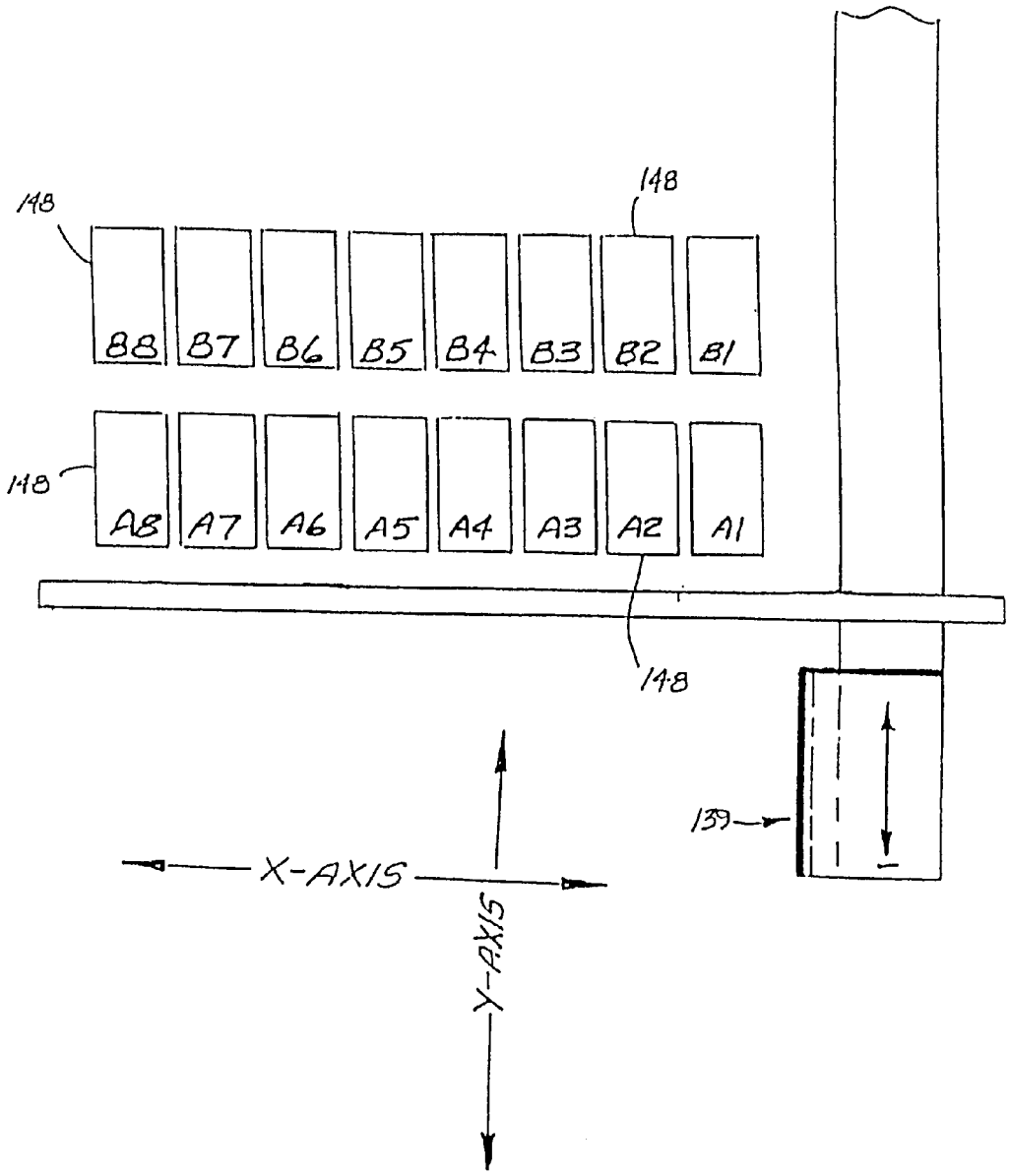
FIG. 12 is a diagrammatical plan view showing the positional relationship of the sheet material clamp assembly relative to the two columns of eight rows of tool assemblies.

In the manner described hereinabove, the sheet material to be processed is first clamped by the sheet material clamp assembly 139 and then moved in x-axis and y-axis coordinate segment combinations to position the sheet material in determined positions to be processed by the desired tool assembly 148. FIG. 12 shows a diagrammatical top view layout of the tool assemblies 148 which are arranged in two columns of eight.

Figure 15:
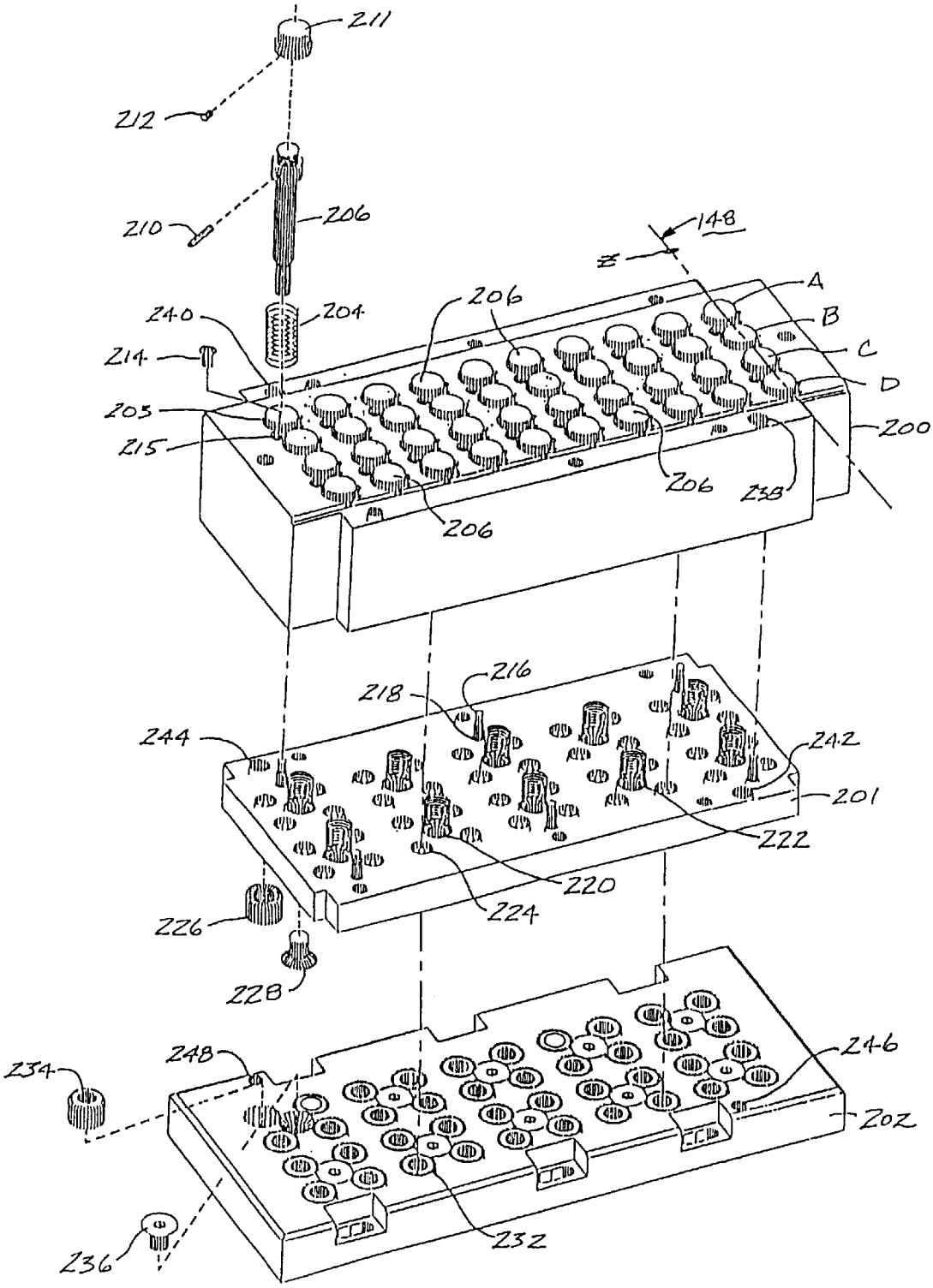
FIG. 15 is an isometric, partially exploded view of a tool assembly supporting punching tooling.

As shown in FIG. 15, the tool assembly 148 has a punch magazine 200 with a stripper plate 201 depending therefrom and a matingly aligned die block 202. The punch magazine 200 forms a plurality of apertures 203 which are counterbored to receivingly support a spring 204. A conventional punch 206 and conventional threaded adapter that is attached by a roll pin 210 are slidingly supported in the aperture 203 by the spring 204. A threaded punch cap 211 engages the threaded adapter and is secured thereto by the tightening of a set screw 212. In this manner, the effective length of the punch 206 can be adjusted according to the threadingly advanced position of the punch cap 211. This adjustment makes it possible to extend the useful life of the tooling by allowing dull punches to be sharpened and reused. Cap screws 214 in threaded apertures 215 engage the punch caps 211 to retain the punches 206 in the punch magazine 200.

The stripper plate 201 is attached to the punch magazine 200 by a plurality of shoulder bolts 216 passing slidingly through clearance apertures 218 in the stripper plate 201 and threadingly engaging the punch magazine 200 at a distal end. A plurality of detents 220 are formed in the top surface of the stripper plate 201 that are in mating alignment with detents (not shown) formed in the bottom surface of the punch magazine 200. A plurality of stripper springs 222 are compressively disposed within the detents 220 to bias the stripper plate 201 spatially apart and parallel to the punch magazine 200. The stripper plate 201 receivingly supports a plurality of stripper dies 226. A screw 228 engages a threaded aperture on the bottom side of the stripper plate 201 to retain the stripper dies 226 within the stripper plate 201.

The die block 202 forms die apertures 232 that are matingly aligned with the punches 206 in the punch magazine 200. A plurality of dies 234 are supported in the die apertures 232 and are retained therein by a plurality of die screws 236.

In tool set-up the dies 234 are first aligned to the punches 206. Alignment is provided by pairs of reference alignment apertures 238, 240 in the punch magazine 200, alignment apertures 242, 244 in the stripper plate 201, and alignment apertures 246, 248 in the die block 202. The components of the tool assembly 148 are aligned during set-up by passing a first appropriately sized alignment tool (not shown) through the alignment apertures 238, 242, 246, and a second appropriately sized alignment tool (not shown) through the alignment apertures 240, 244, 248. With the alignment tools in place, the die block 202 is secured to its underlying support (to be discussed further below). The alignment tools are then removed and set aside. Once aligned and secured, the punch magazine 200 and the die block 202 remain at all times in a fixed coaxial alignment during processing of the sheet material.

During press assembly 10 operation the sheet material being processed is positioned between the stripper plate 201 and the die block 202 of the desired tool assembly 148. The selected punch 206 is driven downward by a punching assembly to engage the sheet material and the die 234.

Figure 16:
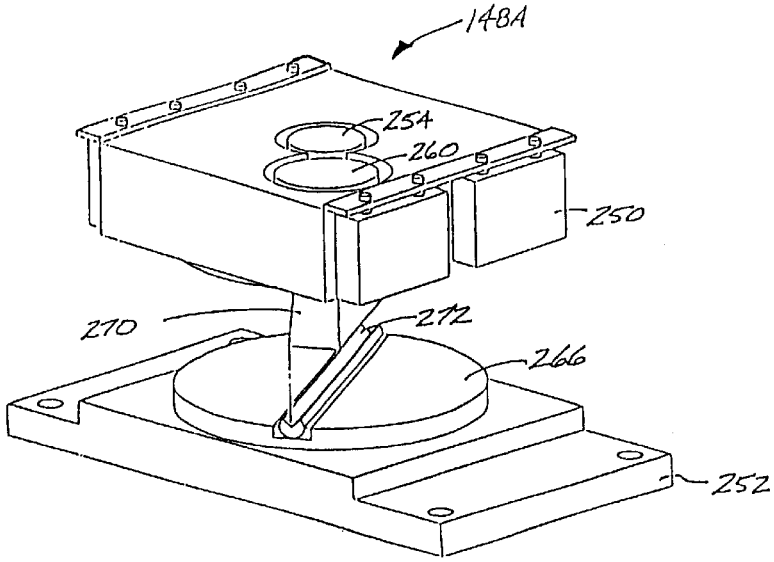
FIG. 16 is an isometric view of an indexing tool assembly supporting braking tooling.
Figure 16A:
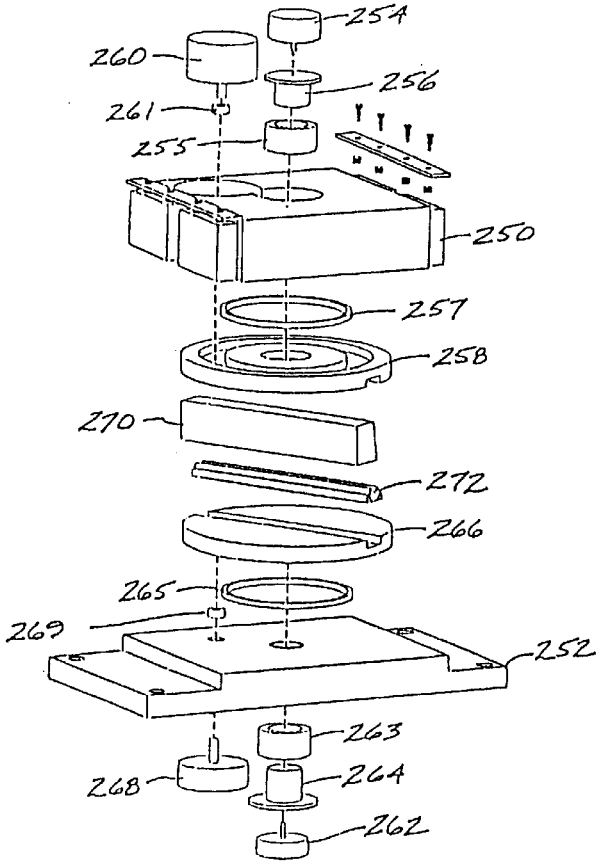
FIG. 16A is an exploded assembly view of the tool assembly of FIG. 16.

FIGS. 16 and 16A show an indexing braking tool assembly 148A having an indexing braking magazine assembly 250 and an indexing die block assembly 252, both capable of rotating supported tooling about a z-axis which is perpendicular to the x-y plane. As shown in FIG. 16A, the indexing braking magazine assembly 250 supports a bearing 255 which, in turn, supports an encoder 254 and a shaft 256. A bearing plate 258 is centrally attached to the distal end of the shaft 256 and is rotatably supported by a bearing 257 for selective positioning in response to the encoder 254 and a motor 260 having a shaft mounted gear 261. In like manner, the indexing die block assembly 252 supports a bearing 263 which, in turn, supports an encoder 262 and a shaft 264. A bearing plate 266 is attached to the distal end of the shaft 264 and is thereby coextensively rotated upon a bearing 265 and positioned in response to the encoder 262 and a motor 268 having a shaft mounted gear 269.

FIG. 16 shows a forming punch 270 supported by the bearing plate 258, and a forming die 272 supported by the bearing plate 266. In the illustrated embodiment the forming die 272 is a conventional rocker-die type. The motors 260, 268 cooperatively rotate the forming punch 270 and forming die 272 to selected rotational positions to perform forming operations, such as flanges and offsets, on the sheet material being processed. The size of this indexing braking tool assembly 148A may be the same as that of the tool assembly 148 described above, or it may be larger and thus occupy the space of two or more tool assemblies 148.

Figure 6:
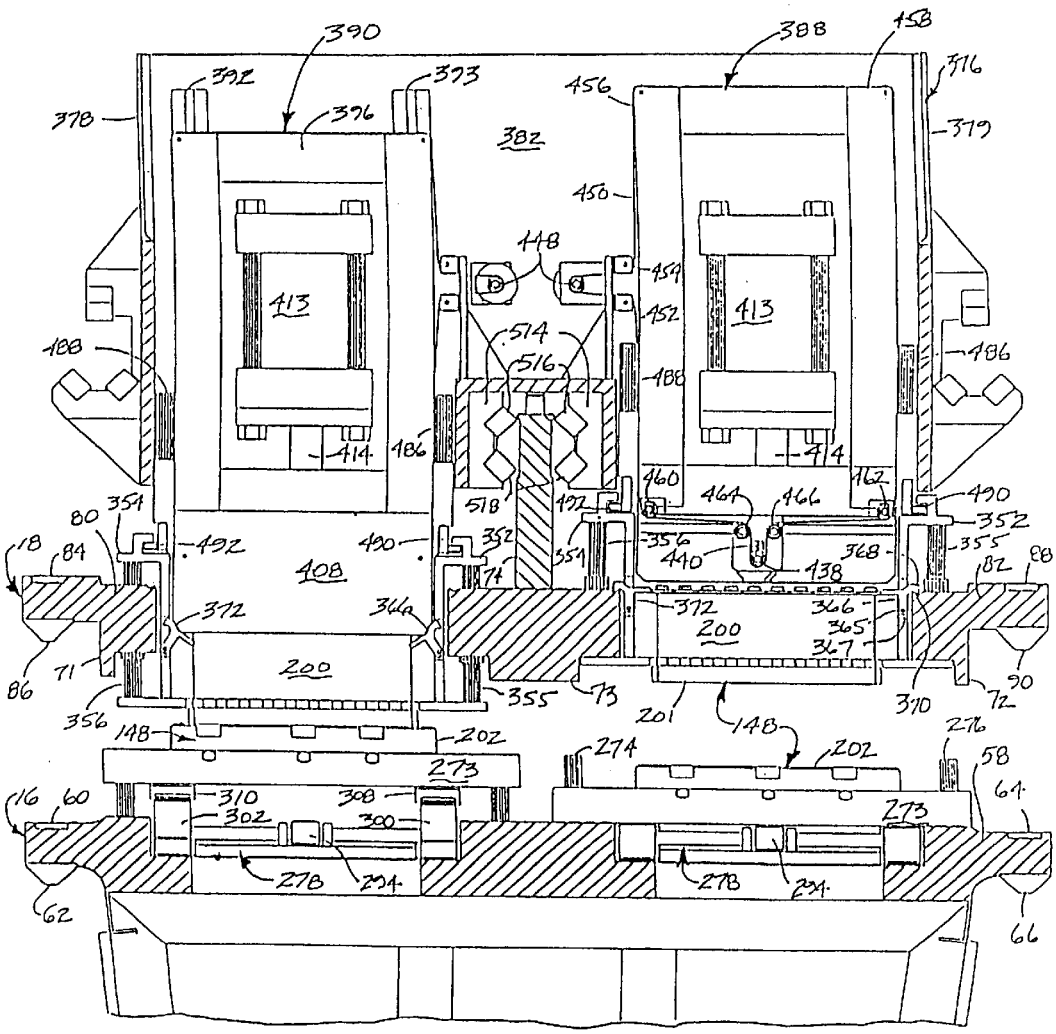
FIG. 6 is an enlarged detail of a portion of FIG. 5, showing the operable engagement of the punching head assemblies with the magazine supports and punch magazines.

Turning now to FIG. 6, it will be noted each die block 202 is supported by a die lifter block 273. The die lifter block 273 on the right-hand side of FIG. 6 is in a recessed mode and the left-hand side die lifter block 273 is in an operable mode. The die lifter block 273 in the recessed mode is supported by the bolster frame 16. Opposing pairs of sleeve bearings 274, 276 are disposed through receiving apertures in the die lifter block 273 to permit vertical movement of the die lifter block 273. The die blocks 202 of the inoperable tool assemblies 148 are clearingly recessed below a sheet material supporting link belt assembly, to be discussed below. The die blocks 202 are raised and lowered by a pair of die block lifter assemblies 278.

Figure 17:
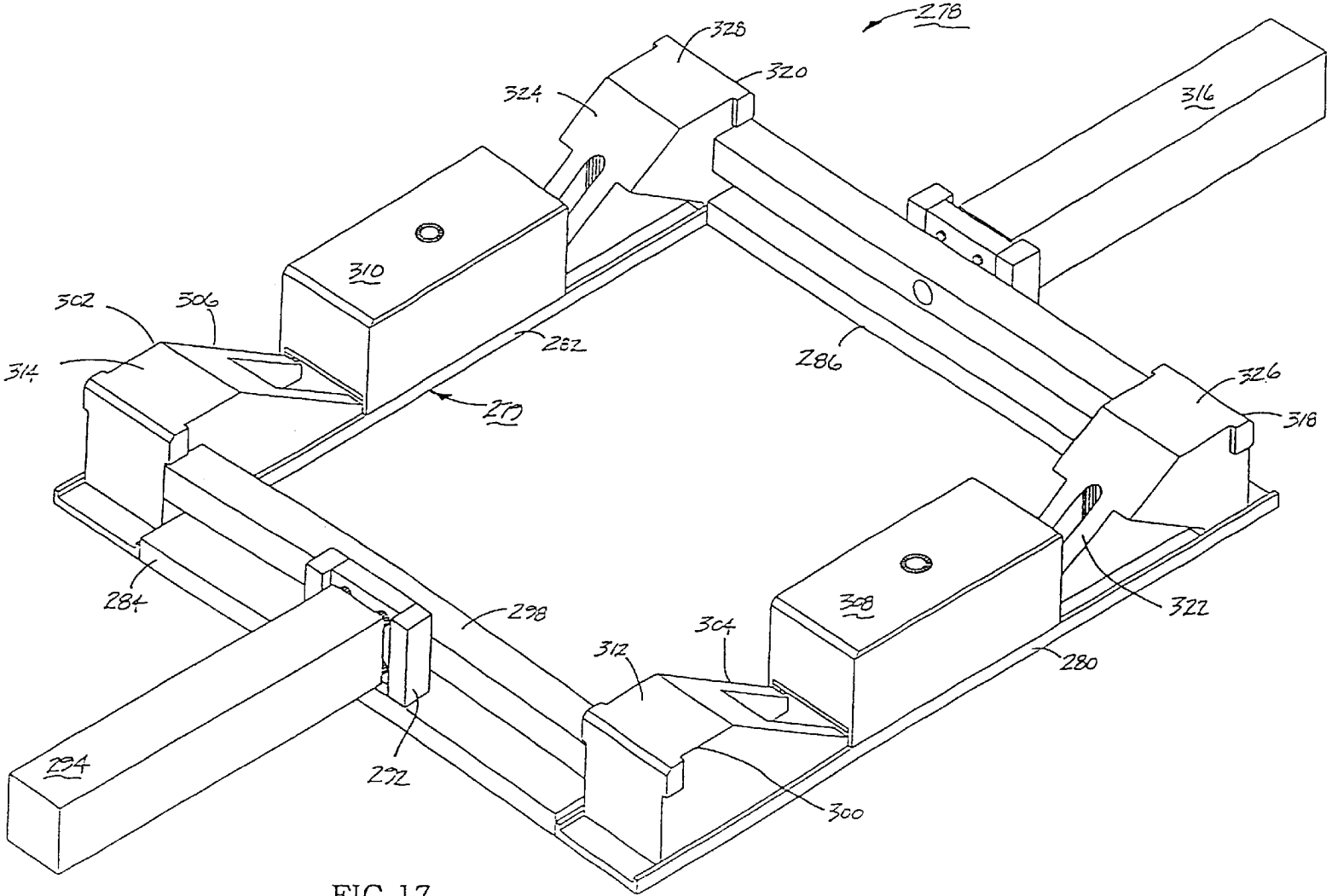
FIG. 17 is an isometric view of the die block lifter assembly.

FIG. 17 shows the die block lifter assembly 278. It will be understood that a frame assembly 279 is formed by the joining of opposed channels 280, 282 to cross supports 284, 286. A cylinder mount 292 is supported by the cross support 284, which in turn, supports a cylinder 294. The distal end of the cylinder shaft is attached to a lifter block cross bar 298. A pair of lifter blocks 300, 302 depend from each end of the lifter block cross bar 298 and are maintained in sliding engagement within the channels 280, 282 respectively. The lifter blocks 300, 302 have bevelled portions 304, 306 which engage a pair of top blocks 308, 310.

The top blocks 308, 310 have bevelled portions on the bottom sides thereof to receivingly engage the bevelled portions 304, 306 of lifter blocks 300, 302. In the cylinder 294 retracted mode shown in FIG. 17, the bevelled portions 304, 306 do not engage the top blocks 308, 310. When the cylinder 294 is activated the lifter blocks 300, 302 are displaced along the channels 280, 282 and engage the bottom sides of the top blocks 308, 310. At the extent of cylinder 294 shaft travel, the lifter blocks 300, 302 support the top blocks 308, 310 upon flat portions 312, 314 to provide precise upward displacement of the top blocks 308, 310.

Similarly, an opposing cylinder 316 activates to displace a pair of lifter blocks 318, 320 thereby engaging the top blocks 308, 310 at bevelled portions 322, 324. At a fully extended cylinder 316 position the top blocks 308, 310 are supported upon flat portions 326, 328. When both cylinders 294, 316 are activated, the lifter blocks 300, 318 converge and interlace as the bevelled portion 322 passes into a cavity formed in the bevelled portion 304. Likewise, the bevelled portion 324 of the lifter block 320 is disposed in a cavity formed in the bevelled portion 306 of the lifter block 302. Fully extended cylinders 294, 316 therefore lift the top blocks 308, 310 as shown in FIG. 6.

Figure 18:
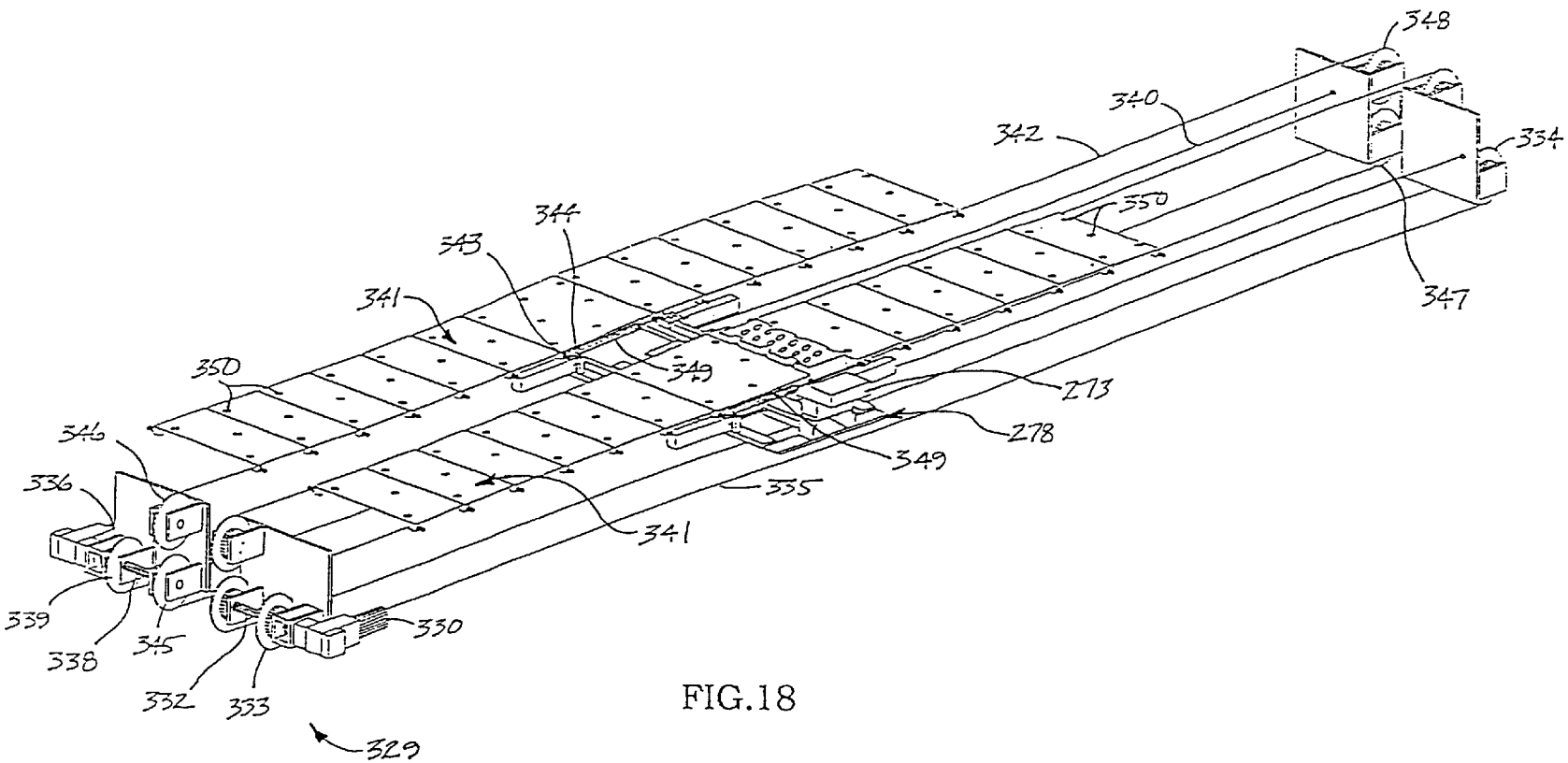
FIG. 18 is an isometric view of the link belt assembly and the drive assembly that positions the die block lifter assembly and the link belt assembly.

FIG. 18 shows a drive assembly 329 that independently moves the pair of die block lifter assemblies 278 to determined positions under the plurality of die lifter blocks 273. It will be noted that a motor 330 drives an output shaft 332. A pulley 333 disposed on the output shaft 332 and a free wheeling pulley 334 support a belt 335 which is attached to the cross supports 284, 286. The first die block lifter assembly 278 is attached to the belt 335 and is thereby positioned by the motor 330. The second die block lifter assembly 278 is similarly positioned by a motor 336 communicating motion to an output shaft 338, a driven pulley 339, a free wheeling pulley (not shown), and a belt 340 supported thereby.

Each drive assembly also positions a link belt assembly 341. The link belt assembly 341 is supported for movement upon guides (discussed below) and moves in unison with the movement of the die block lifter assembly 278 as described in the following.

The link belt assembly 341 supports a plurality of roller bearings 350 which support the sheet material, thereby minimizing frictional resistance as the sheet material is moved to determined positions.

The second link belt has a belt 342 attached thereto at a first end 343, and at a second end 344 in close proximity to the first end 343. The belt 342 is supported between the first end 343 and the second end 344 by a driving pulley 345 and a plurality of idler pulleys 346, 347, 348. The driving pulley 345 is supported by the output shaft 338 and is thereby responsive to the motor 336.

The link belt assembly 341 has a cylinder 349 that is supported at a fixed end adjacent the first end 343 of the belt 342 and has a distal shaft end that is attached to a separable portion of the link belt. Activation of the cylinder 349 affects linear displacement of the separable portion of the link belt. This displacement creates an opening through which the die block lifter assembly 278 lifts the die block 202, in the manner described above, to supportingly engage the sheet material being processed.

The CNC control system positions the die block lifter assembly 278 and the link belt assembly 341 to a position adjacent the desired tool assembly 148. To make a desired tool assembly 148 operable the cylinder 349 first activates to create the opening above the die block lifter assembly 278. The CNC control system then activates the cylinders 294, 316 to raise the die lifter block 273. To return to a recessed mode, the CNC control system deactivates the cylinders 294, 316 and deactivates the cylinder 349.

Figure 19:
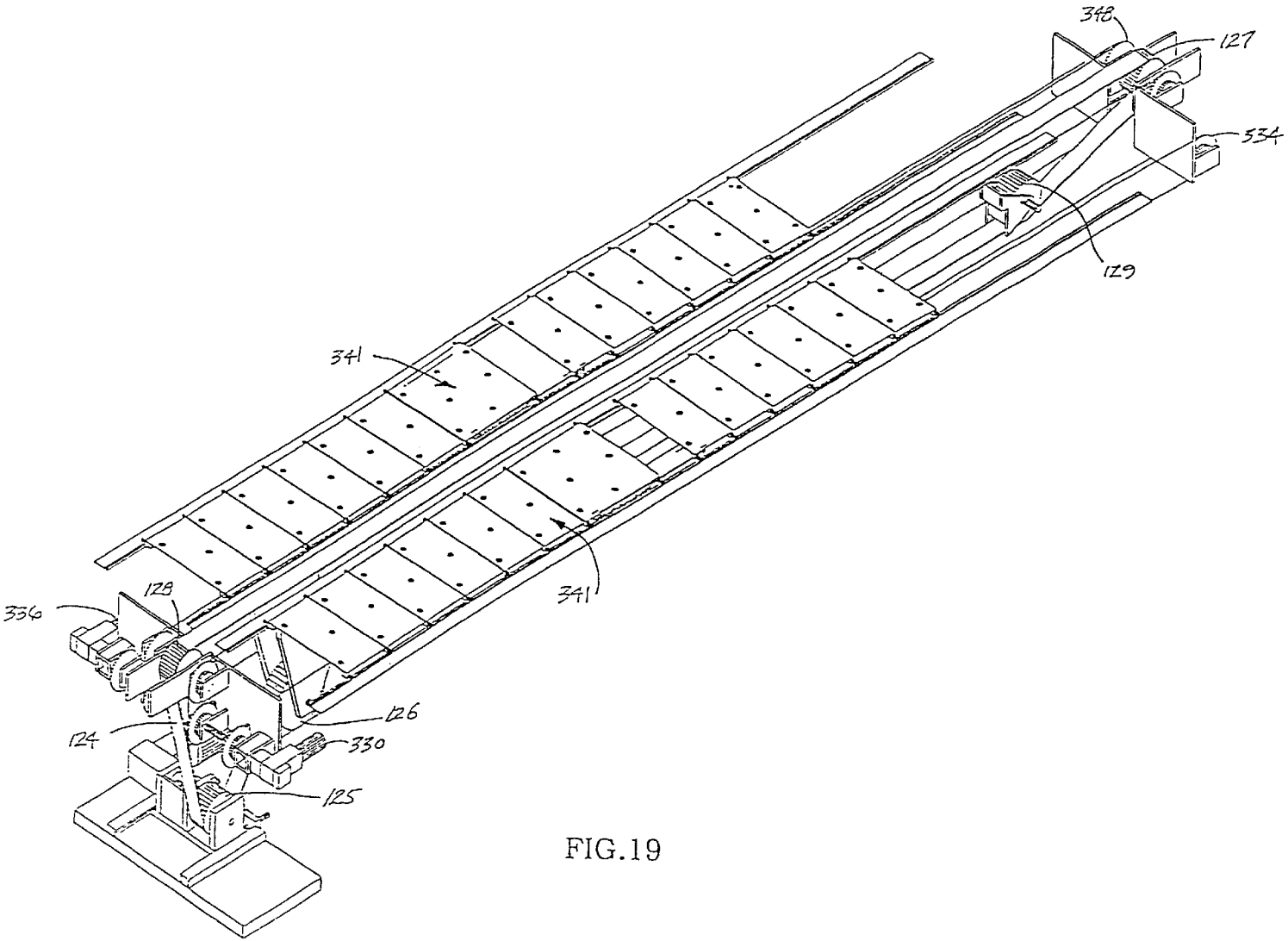
FIG. 19 is an isometric view showing the x-axis frame assembly drive mechanism and the die block lifter assembly and link belt assembly drive mechanism.
Figure 20:
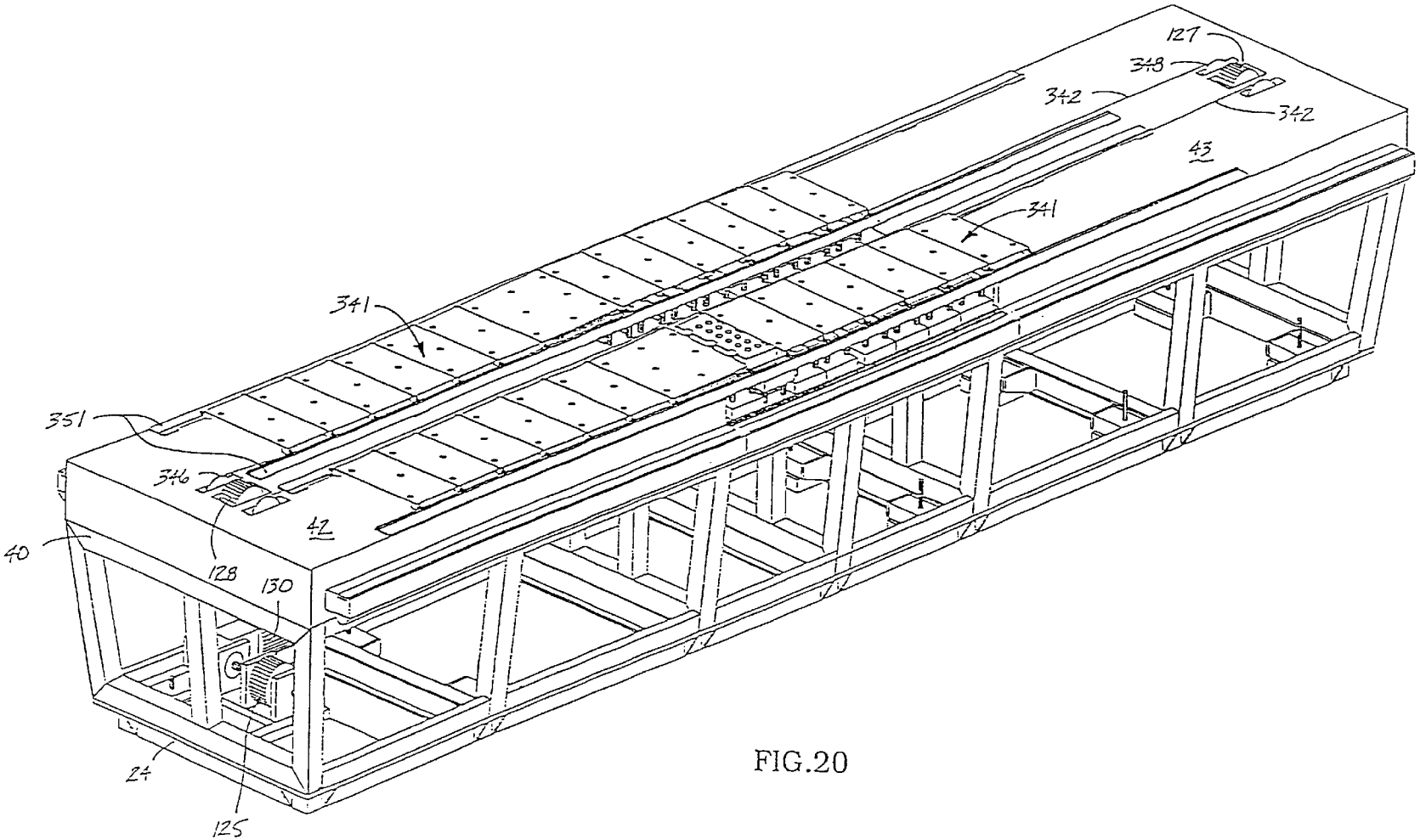
FIG. 20 is an isometric view of a portion of the press assembly of FIG. 1 showing the link belt assembly guide rails supported by the bolster frame.

FIG. 19 shows another view of the link belt assembly 341 positioning assembly and the drive assembly for the x-axis frame assembly 100. FIG. 20 shows yet another view of the bolster frame 16 supporting both the link belt assembly 341 positioning assembly and the drive assembly for the x-axis frame assembly 100. The link belt assembly 341 has supporting roller bearings which engage opposing guide rails 351 which are attached to the first and second lower support members 42, 43.

Returning now to FIG. 6, it will be noted that the magazine support frame 18 has a pair of opposing magazine supports 352, 354 that receivingly support a punch magazine 200. Although a punch magazine 200 is illustrated, the opposing magazine supports 352, 354 likewise can receivingly support the previously described indexing braking magazine assembly 250 (see FIG. 16). Each magazine support 352, 354 is supported for vertical movement by pairs of opposing sleeve bearings 355, 356 which are disposed in appropriately sized apertures in the right-hand magazine bridge member 72 and the central magazine bridge member 73. In like manner, the magazine support frame 18 has a pair of opposing magazine supports 352, 354 slidingly engaged for vertical movement in pairs of opposing sleeve bearings 355, 356 which are disposed in appropriately sized apertures in the central magazine bridge member 73 and the left-hand magazine bridge member 71.

The magazine support 352 has a pin 365 extending therefrom that rotatably supports a toggle 366 and a coil spring 367 that biases the toggle 366 to a position outwardly away from the punch magazine 200. The toggle 366 forms a hook portion 368 which engages a detent portion 370 formed by the right-hand magazine bridge member 72, thereby supporting the magazine support 352 in a raised, or recessed, position. The opposing magazine support 354 of the right-hand tool assembly 148 is likewise supported in a recessed position by engagement of a toggle 372 engaged against the central magazine bridge member 73.

When both toggles 366, 372 are engaged with the right-hand and central magazine bridge members 72, 73 the magazine supports 352, 354 support the punch magazine 200 in a recessed position. This recessed position of the punch magazine 200 provides ample clearance between the sheet material being processed and all inoperable tool assemblies 148 to allow formed portions of the sheet material, such as flanges, offsets, or extrusions, to be moved about without interference with the punch magazine 200 or the stripper plate 201. A recessed punch magazine 200 must be lowered to an operable position in order to perform processing operations on the sheet material.

Figure 21:
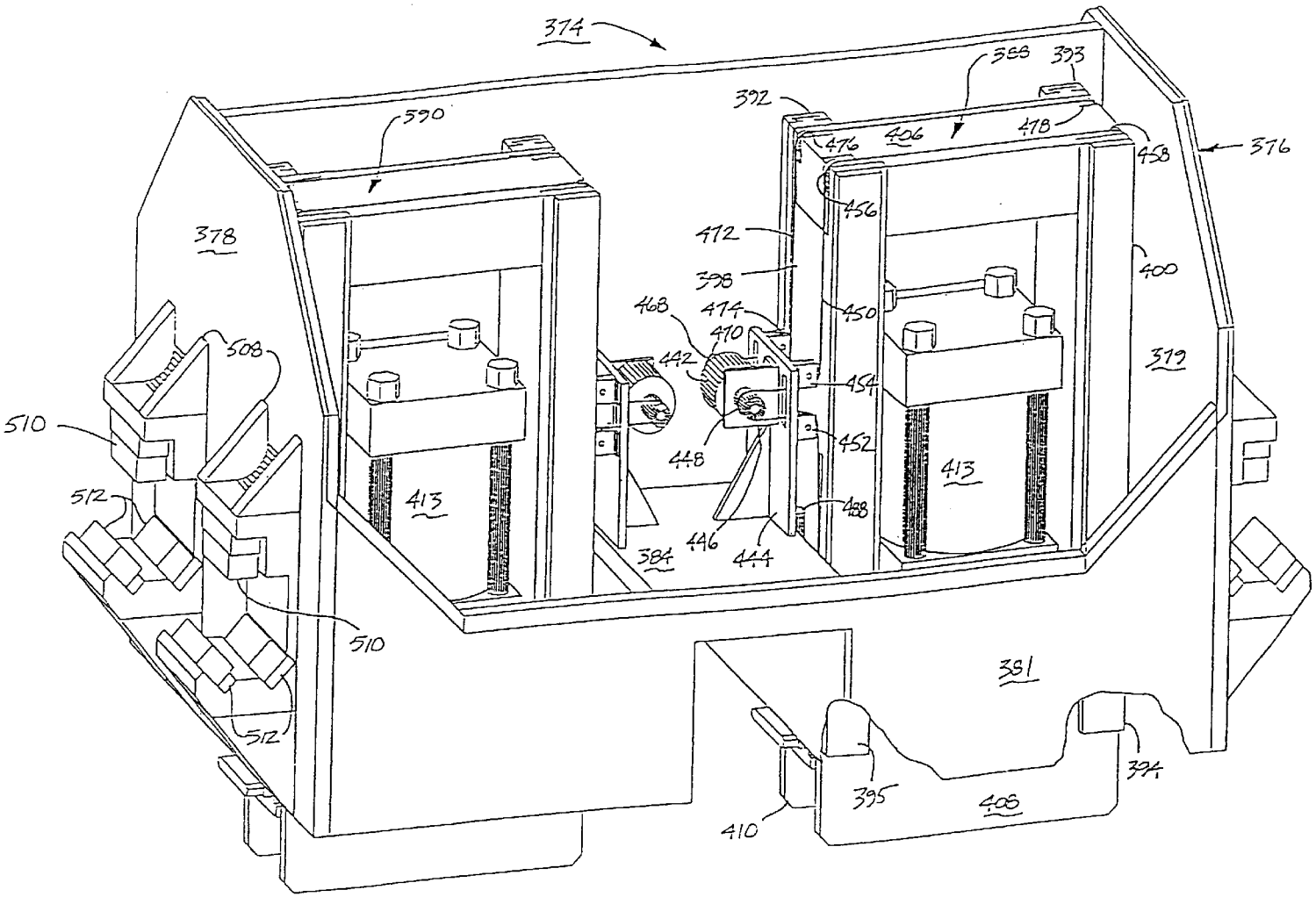
FIG. 21 is an isometric, partially cutaway view of the punching head assembly.

To lower a recessed punch magazine 200, the toggles 366, 372 must be disengaged from the right-hand and central magazine bridge members 72, 73. FIG. 21 shows a punching head assembly 374 which first lowers the punch magazine 200 to an operable position and then imparts a punching force to a selected punch 206. The punching head assembly 374 has a head housing 376 that is formed by the joining of side members 378, 379 to a rear member 380 and a front member 381. A rear cross member 382 and a front cross member 383 are attached intermediate and parallel to the rear member 380 and the front member 381. A central support assembly 384 is attached to the front and rear members 381, 380 and the rear and front cross members 382, 383 (See FIG. 22, not shown in FIG. 21). The head housing 376 provides support for a pair of punch assemblies 388, 390 and a cover 385 (see FIG. 1).

As shown in FIG. 21, the two punch assemblies 388, 390 are substantially equivalent in construction, so the following discussion of punch assembly 388 likewise describes the construction of the punch assembly 390. The rear cross member 382 supports a pair of linear bearings 392, 393. The front cross member 383 (see FIG. 22) supports a pair of linear bearings 394, 395. The linear bearings 392, 393 and 394, 395 slidingly support an interposer frame 396 in vertical movement thereof.

Figure 24:
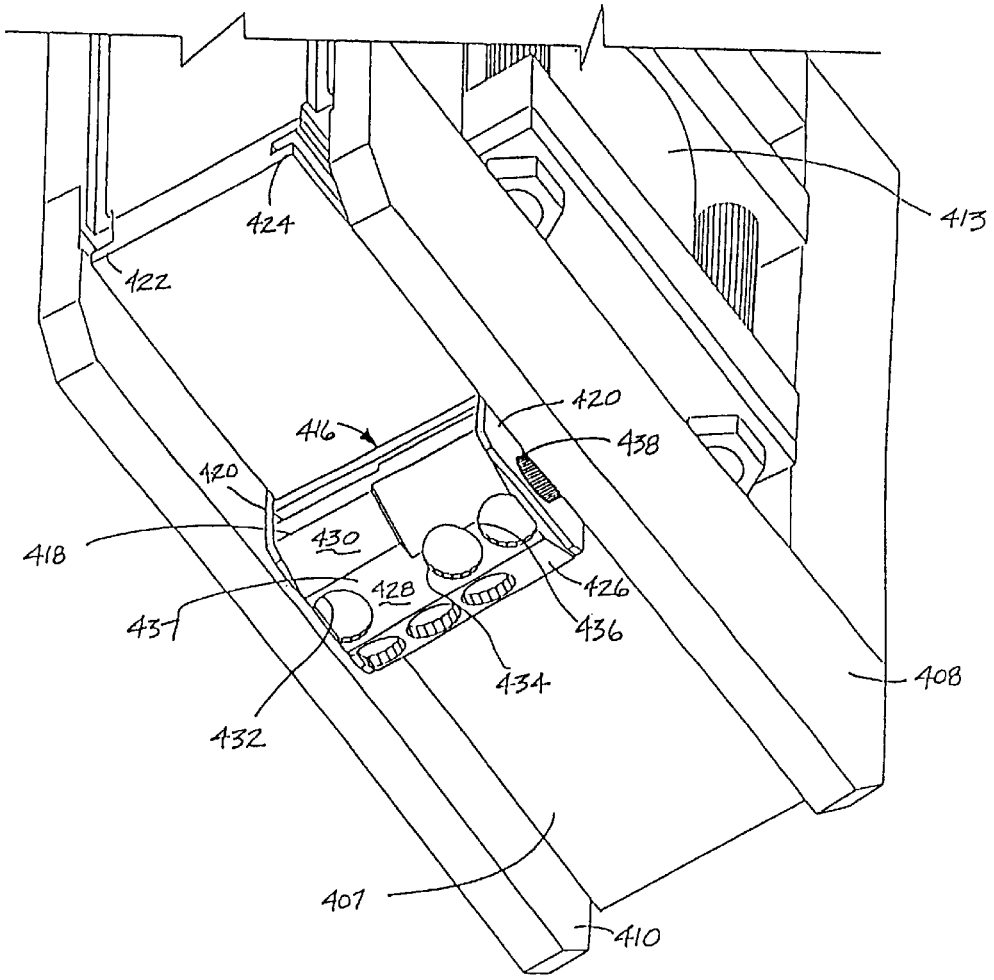
FIG. 24 is an isometric bottom view of a portion of the punching head assembly showing the selector assembly.

The interposer frame 396 has a pair of opposing side members 398, 400 joined at the top portions thereof by a top member 406 and joined at the bottom portions thereof by a ram member 407 (see FIG. 24). A front interposer plate 408 and a rear interposer plate 410 are supported by the ram member 407. The interposer frame 396 is slidingly supported to provide vertical movement by engagement of the linear bearings 392, 395 with the side member 398 and engagement of the linear bearings 393, 394 with the side member 400.

A punch cylinder 413, supported by the rear cross member 382 and the front cross member 383 (see FIG. 22), has an extensible cylinder shaft 414 (see FIGS. 6 and 23) attached at a distal end to the ram member 407. The punch cylinder 413 reciprocatingly supports the interposer frame 396 during processing of the sheet material. Although the disclosed embodiment uses a hydraulic cylinder to provide the reciprocating punching force, one skilled in the art will recognize it is conventional to alternatively employ a clutch operated motor driving a crankshaft supported ram.

Figure 23:
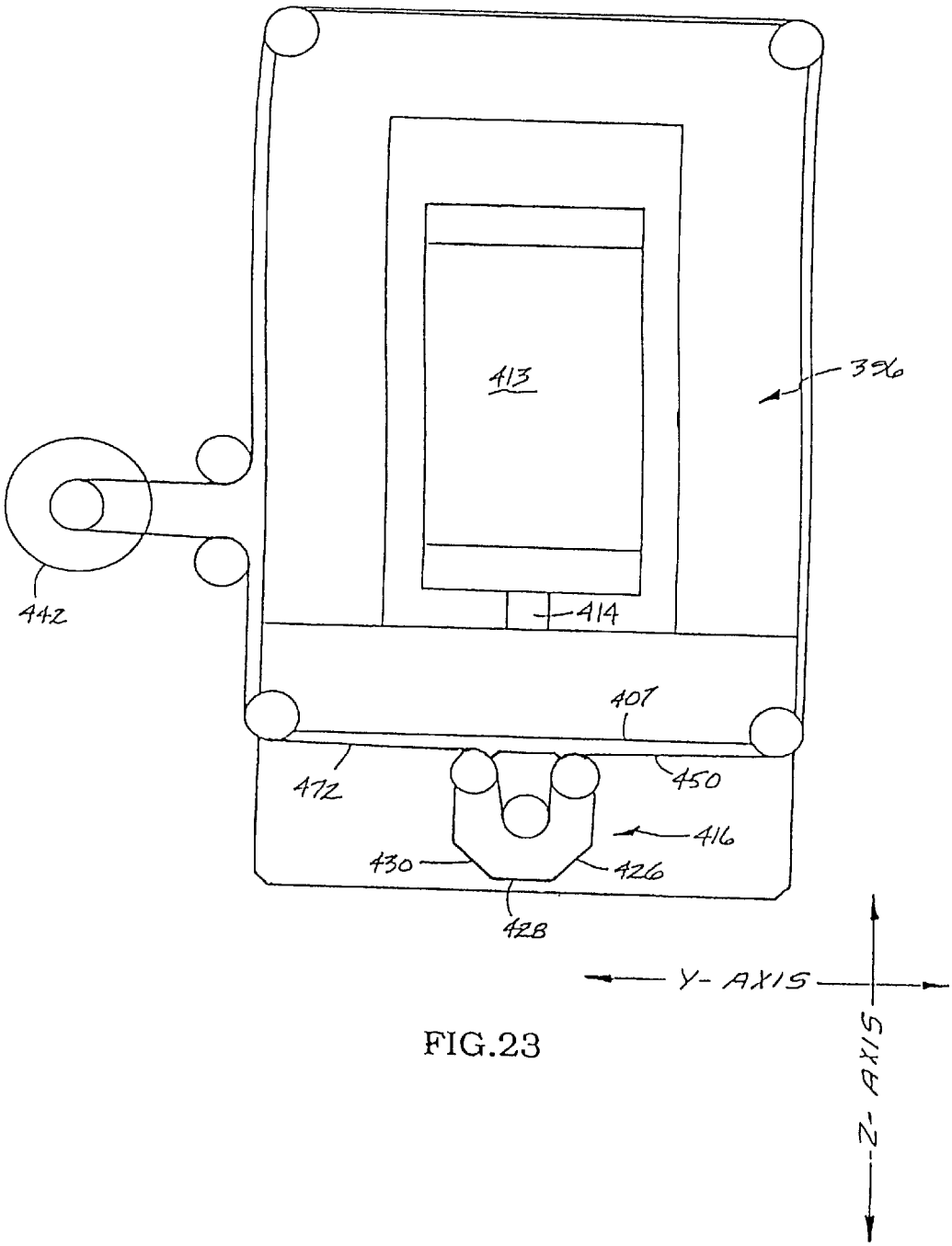
FIG. 23 is a diagrammatical view showing the selector assembly having an octagonal selector member that is rotated and linearly positioned by a drive motor.

FIG. 23 is a diagrammatical view of the punch assembly 388 showing a selector assembly 416 supported by the interposer frame 396. The selector assembly 416 is slidingly supported by the ram member 407 for linear displacement in the y-axis direction. The selector assembly 416 is engaged by the ram member 407 and transmits the downward punching force of the punch cylinder 413 to a selected punch 206 (not shown) disposed in the punch magazine 200 (not shown). As shown in FIG. 24, the selector assembly 416 has a selector member 418 supported by a selector frame 420. The selector frame 420 has tab portions which engage opposing guides 422, 424 in the ram member 407. The selector member 418 is an octagonal shaped member, and each face thereof forms characteristic relief portions which clear rather than engage the non-selected punches 206. The selector frame 420 rotatably supports the selector member 418 so that any of the eight faces of the selector member 418 can be located at the striking (bottom) position and thereby be used to selectively transmit the punching force of the punch cylinder 413.

It will be noted that three faces 426, 428 and 430 of the selector member 418 are shown in FIG. 24. In the illustrated position of the selector member 418, the face 428 is in the striking position. The face 428 will contact the selected punch 206 upon punch cylinder 413 activation. As illustrated, the face 428 has three recessed or detent portions 432, 434, 436 formed therein thereby reducing the effective contact surface of the face 428 to only a land portion 437. The characteristic configuration of the faces of the selector member 418 operably cooperate with the size and location of the punches 206 in the punch magazine 200. For example, with reference to FIG. 15, if the selector assembly 416 (in the position depicted in FIG. 24) is positioned directly above the four punches shown in the punch magazine 200 in row Z, activation of the punch cylinder 413 will affect striking only one of the four punches 206 in the row. The punches 206 in row Z which are aligned with the detent portions 432, 434, 436 of the face 428 will not be struck because the respective punch caps 211 will clearingly be disposed within the detent portions 432, 434 and 436. The land portion 437 of the face 428 will strike only the punch 206 shown in position B.

If, however, the selector member 418 is rotated so that its face 426 (see FIG. 24) is at the striking position, activation of the punch cylinder 413 will still strike only one of the punches 206, but not the same one as before. In this case, the detent portions will prevent striking the punches 206 in positions A, B, and C, and the land portion of the face 426 will strike only the punch 206 in position D. If the selector member 418 is rotated so that face 430 is at the striking position, the punches 206 in positions A and B will be stricken but the punches 206 in positions C and D will not be stricken.

Returning to FIG. 24, a selector member pulley 438 is attached to the selector member 418 and is slidably supported by a vertical slot in the selector frame 420. The selector frame 420 furthermore supports the distal end of the selector member 418 by the engagement of a support portion formed by the selector member 418 in an opposing vertical slot in the selector frame 420. A compression spring 440 (FIG. 6) biases the selector member 418 downward, away from the ram member 407, to provide clearance for rotation of the selector member 418.

Returning to FIG. 21, it will be noted that a motor 442 that provides both linear positioning of the selector frame 420 and rotational positioning of the selector member 418. The motor 442 is supported by a motor mounting bracket assembly 444 attached to the central support assembly 384 of the head housing 376.

The motor has a first output shaft 446 supporting a first clutch 448. As shown in FIG. 6, a first belt 450 engages the first clutch 448 and is trained over a pair of pulleys 452, 454 which are supported by the motor mounting bracket assembly 444, furthermore around a pair of top pulleys 456, 458 which are supported by the top member 406, furthermore around a pair of bottom pulleys 460, 462 which are supported by the ram member 407, furthermore around a pair of selector frame pulleys 464, 466 which are supported by the selector frame 420, and finally around the selector member pulley 438. When the linear position of the selector assembly 416 remains fixed, engagement of the first clutch 448 imparts rotation to the selector member 418 by way of the first belt 450 communicating rotation to the selector member pulley 438.

FIG. 21 furthermore shows the motor 442 has an opposing second output shaft 468 supporting a second clutch 470. A second belt 472 engages the second clutch 470 and has a first end connected to the selector frame 420 and passes over pulleys 474, 476, 478 and a bottom pulley therebetween. The second belt 472 furthermore has a second end connected to an opposing end of the selector frame 420 and passes over a plurality of pulleys in like manner. Engagement of the second clutch 470 imparts linear displacement to the selector assembly 416 along the ram member 407, by way of the second belt 472 communicating linear displacement to the selector frame 420.

As described hereinabove, the first clutch 448 and the second clutch 470 cooperatively position and rotate the selector assembly 416 above the plurality of punches 206 in the punch magazine 200. To linearly displace the selector assembly 416, both the first clutch 448 and the second clutch 470 are engaged. The second clutch 470 moves the selector frame 420 linearly, and the first clutch 448 compensates for the linear movement so that no rotation is imparted to the selector member 418. To rotate the selector member 418 only the first clutch 448 is engaged.

Returning to FIG. 6, it will be understood that the right-hand tool assembly 148 is in a recessed mode and is thereby inoperable. In this recessed mode the magazine supports 352, 354 are supported by the magazine support frame 18 by the pressing engagement of the toggles 366, 372. To move a recessed punch magazine 200 into an operable position for processing the sheet material, the toggles 366, 372 are rotated inwardly to passingly clear the edges of the right-hand and central bridge members 72, 73. The left-hand tool assembly 148 of FIG. 6 illustrates the position of the toggles 366, 372 in the operable position.

To disengage the toggles 366, 372, a pair of lift cylinders 486, 488 are attached to the side members 398, 400 and have shaft distal end portions 490, 492 that, when retracted, engage an extended portion of the magazine supports 352, 354. The lift cylinders 486, 488 are first retracted thereby bearing the weight of the punch magazine 200 and thus relieving the support of the toggles 366, 372. The punch cylinder 413 is then extended causing the bevelled corner portions of the front interposer plate 408 to pressingly engage lever portions of the toggles 366, 372 which affects inward rotation against the outward bias force of the coil springs 367. Downward movement of the interposer frame 396 causes engagement of the selected punches 206 against the bottom face of the selector member 418 and compresses the compression spring 440 as the selector member 418 moves upwardly within the selector frame 420 until the opposing face (opposite the striking face) of the selector member 418 is pressingly engaged against the ram member 407. In this mode, the force from the punch cylinder 413 is transmitted through the selector member 418 to the selected punches 206.

Simultaneously, the die block lifter assembly 278 is positioned below the corresponding die block 202 and activates, as described above, to lift the die block 202 to supportingly engage the sheet material being processed. The punch assembly 388 thereafter reciprocates the punch 206 against the mating die 234 to pierce or form the sheet material during processing. The stripper plate supports the sheet material during punch withdrawal in the conventional manner of a Class A die.

To select one or more punches 206 in the punch magazine 200, the selector assembly 416 is repositioned or rotated. To reposition or rotate the selector assembly 416 during processing of the sheet material, the punch cylinder 413 first retracts to an intermediate position which does not affect engagement of the toggles 366, 372. The lift cylinders 486, 488 are then extended to lower the punch magazine 200. As the punch magazine 200 lowers, the selector member 418 is biased away from the ram member 407 by the compression spring 440. In this manner it will be understood that a clearance gap is provided between the selector member 418 and the ram member 407 enabling the selector member 418 to rotate within the selector frame 420 and the selector frame 420 to traverse the ram member 407.

After reposition or rotation of the selector assembly 416, the lift cylinders 486, 488 are retracted a sufficient distance so that the ram member 407 engages the selector member 418. The punch cylinder 413 extends so that the stripper plate 201 engages the sheet material being processed, and the punch cylinder 413 reciprocates the punch 206.

The punching head assembly 374 is supported in a manner providing longitudinal x-axis movement to enable access to any of the tool assemblies 148. As has been described hereinabove, the sheet material being processed is moved cooperatively by the x-axis frame assembly 100 and the sheet material clamp assembly 139. To maximize the part throughput velocity it may be preferable to relocate the sheet material while maintaining the punching head assembly 374 position over the desired tool assembly 148 for continued processing. Conversely, it may be preferable to maintain a fixed sheet material position and relocate the punching head assembly 374 over a different row of tool assemblies 148. Furthermore, it may be preferable to do both simultaneously, to reposition the sheet material and the punching head assembly 374 to new locations. Clearly, the optimal approach depends on factors such as tool location and reposition time. Optimal programming practices will require all three sheet material and/or punching head assembly 374 scenarios.

The punching head assembly 374 has outboard support provided by the x-axis frame assembly 100. FIG. 5 shows a punch frame support portion 494 of the side frame member 102 which supports a top guide rail 496 and a bottom guide rail 498. Opposingly, and in like manner, a punch frame support portion 500 depends from the side frame member 104 and supports a top guide rail 502 and a bottom guide rail 504. Inboard support is provided by the bridge beam 74 which supports a pair of opposing guide rails 506.

FIG. 21 shows the punching head assembly 374 has opposing side supports 508 attached to the side members 378, 379. The side supports 508 support top bearings 510 and bottom bearings 512. The top bearings 510 engage the top guide rails 496, 502, and the bottom bearings 512 engage the bottom guide rails 498, 504. FIG. 6 shows the central support assembly 384 (see FIG. 21) has depending therefrom a pair of central support members 514 which support an opposing pair of top bearings 516 and an opposing pair of bottom bearings 518. The top and bottom bearings 516, 518 engage against the guide rails 506 in further support of the punching head assembly 374.

Figure 22:
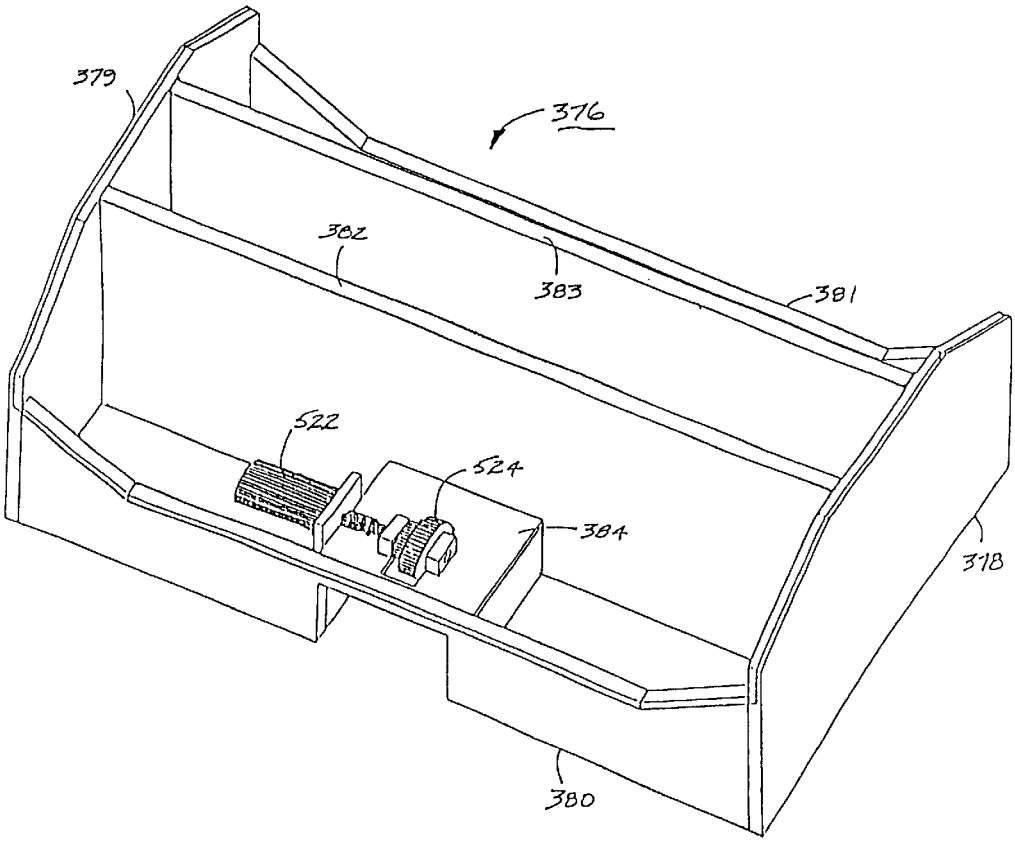
FIG. 22 is an isometric rear view of the head housing assembly showing the support of the x-axis drive mechanism.

As shown in FIG. 3, a gear rack 520 is attached to the bridge beam 74. FIG. 22 shows a motor 522 is supported by the head housing 376 and has a gear 524 depending therefrom that engages the gear rack 520. The punching head assembly 374 is thereby positioned along the x-axis by engagement of gear 524 and gear rack 520.

As described hereinabove, the press assembly 10 has a central frame assembly 12 that supports a two-axis material positioning assembly that delivers determined portions of the sheet material to desired positions. The two-axis material positioning assembly has an x-axis frame assembly 100 and associated drive mechanism, and a sheet material clamp assembly 139 and associated drive mechanism. The central frame assembly 12 furthermore supports a plurality of tool assemblies 148 which are maintained in a fixed position relative the x-y plane. A punching head assembly 374, supported by the material positioning assembly, has an x-axis drive mechanism and a y-axis selector assembly to first position a punching ram over a desired tool assembly 148 and then reciprocate a selected punch. A conventional closed loop CNC system is utilized to control the described motors, clutches, cylinders, and valves.

Figure 25:
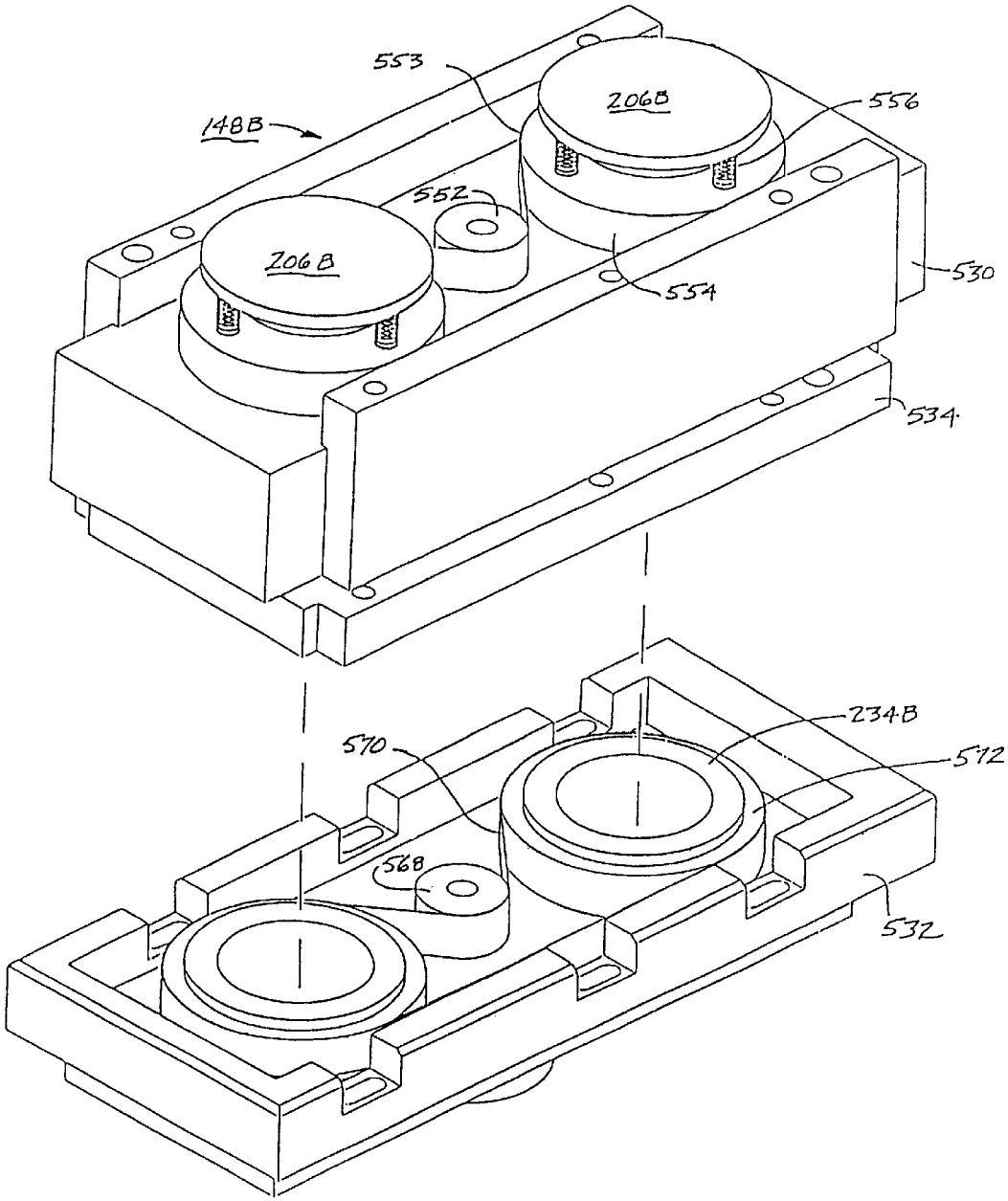
FIG. 25 is an isometric view of an indexing tool assembly supporting punch tooling.

An alternative embodiment of the tool assembly provides rotational displacement of the selected punch and die. The indexing braking tool assembly 148A provides rotation of the punch and die about a z-axis, perpendicular to the x-y plane of sheet material movement. This allows forming operations at different angular orientations by the punch and die. FIG. 25 shows still another alternative embodiment, an indexing punching tool assembly 148B.

The indexing punching tool assembly 148B shown in FIG. 25 has an indexing punching magazine 530 and an indexing die block assembly 532, both capable of rotating supported tooling about a z-axis, perpendicular to the x-y plane. The indexing punching magazine 530 is supported by the opposing pairs of magazine supports 352, 354 (see FIG. 6) and the indexing die block assembly 532 is supported by the die lifter block 273.

Figure 25A:
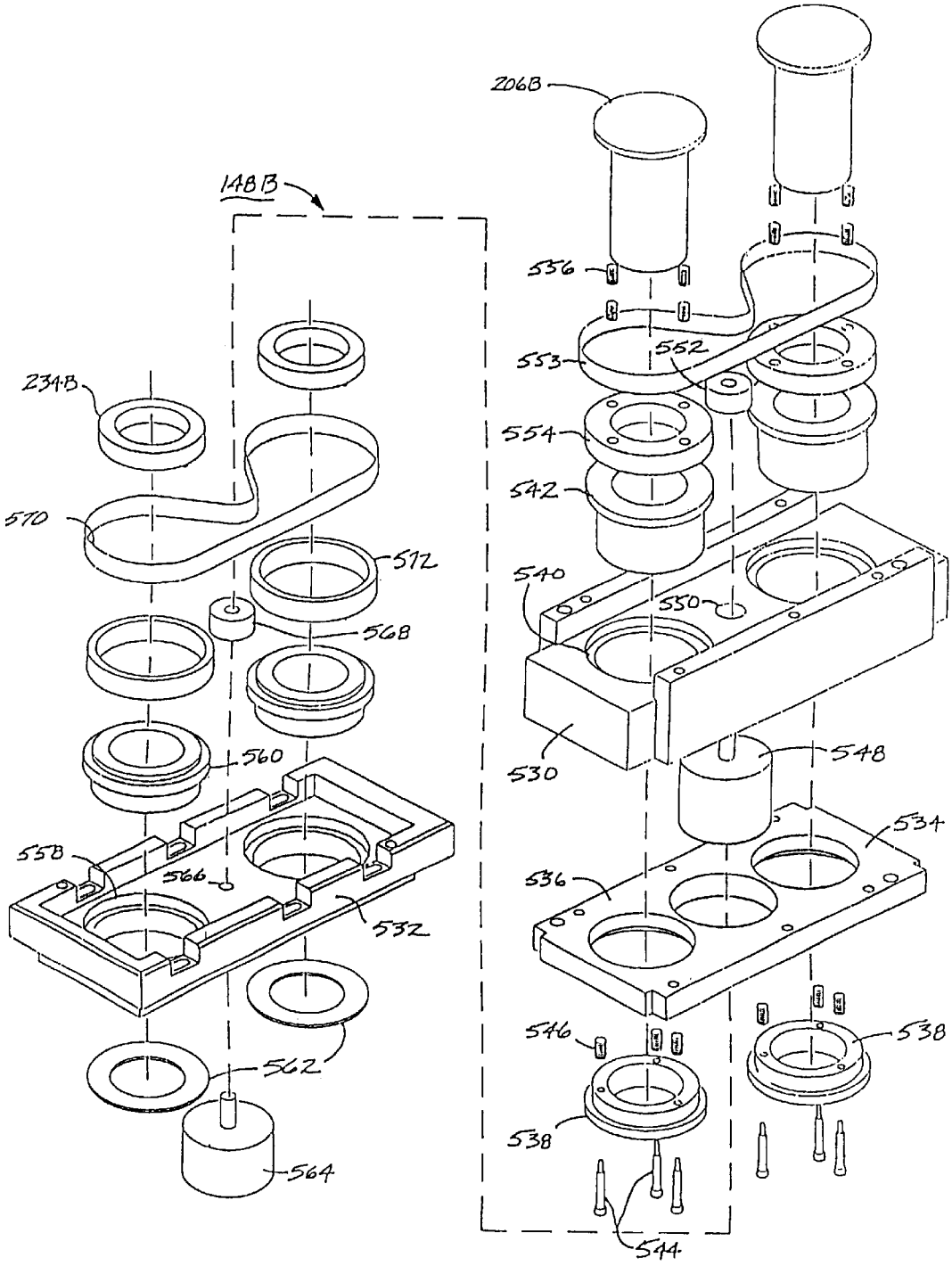
FIG. 25A is an exploded assembly view of the tool assembly of FIG. 25.

Turning to FIG. 25A, shown therein is the indexing punching magazine 530 supporting a stripper plate 534. The stripper plate 534 forms a stripper die aperture 536 which, having a counterbore portion on the bottom side of the stripper plate 534, receivingly supports a stripper die 538.

The indexing punching magazine 530 forms a punch aperture 540 which is in coextensive alignment with the stripper die aperture 536. The punch aperture 540 receivingly engages a punch bushing 542. A plurality of shoulder screws 544 have an unthreaded portion that passes slidingly through apertures in the stripper die 538 and furthermore have threaded distal end portions that threadingly engage the bottom surface of the punch bushing 542. A plurality of compression springs 546 are supported by the shoulder screws 544 and maintain a compressive separating force between the stripper die 538 and the punch bushing 542. A plurality of compression springs, not shown, are disposed between the indexing punching magazine 530 and the stripper plate 534 and maintain a separating force therebetween in a conventional manner.

The indexing punching magazine 530 furthermore supports an encoder motor 548 and forms a shaft aperture 550 through which the encoder motor 548 shaft extends, which at a distal end supports a drive pulley 552. A continuous belt 553 is supported by the drive pulley 552 and a punch pulley 554 which is supported by the punch bushing 542. A punch 206B is supported and keyed to the punch pulley 554 and the punch bushing 542 so that rotation of the punch pulley 554 imparts rotation of the punch 206B, punch bushing 542, and stripper die 538. A plurality of springs 556 are disposed between the punch pulley 554 and the head portion of the punch 206B to support the punch 206B in a normally raised position.

FIG. 25A furthermore shows the indexing die block assembly 532 which cooperatively rotates a punching die 234B in conjunction with the rotation of the matingly aligned punch 206B. The indexing die block assembly 532 forms die bushing apertures 558 which receivingly engage a die bushing 560 for rotation therein. The die bushing 560 is retained in the die bushing aperture 558 by a bearing retainer 562.

The indexing die block assembly 532 supports an encoder motor 564 and forms a shaft aperture 566 through which the encoder motor 564 shaft extends. The encoder motor 564 shaft supports a drive pulley 568. A continuous belt 570 is supported by the drive pulley 568 and a die pulley 572 which is supported by the die bushing 560. The punching die 234B is supported and keyed to the die pulley 572 and the die bushing 560 so that rotation of the die pulley 572 imparts linked rotation of the punching die 234B and die bushing 560.

As described hereinabove, the press assembly 10 cooperatively communicates sheet material movement, punch head location, tool selection, and tool rotation to perform punching,forming,and braking operations. From the above description it is clear that the present invention is well adapted to carry out the objects and to attain the ends and advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the claims.

SUMMARY OF OPERATION

An operator of the press assembly 10 of the present invention loads a sheet of material to be processed into the press assembly 10 by placing the sheet material into the sheet material clamp assembly 139. The CNC control system of the press assembly 10 positions the sheet material clamp assembly 139 to a loading position and orients the sheet material clamp assembly 139 to an unclamped mode to receive the sheet material.

The sheet material clamp assembly 139 includes a plurality of rocker arms 166, each of which is supported by the pin 173 and leveraged by engagement of the compression spring 176, providing a means for biasing the rocker arm 166 to a normally clamped mode. The sheet material clamp assembly 139 furthermore includes the cam 188 which has a plurality of characteristic engagement surfaces adjacent the rocker arm 166. The cam 188 is moved to the extended position by activation of the extensible cylinder 184 and to the retracted position by deactivation of the extensible cylinder 184, thereby providing a means for linearly displacing the cam 188. In the extended position the engagement surface of the cam 188 operably engages the rocker arm 166 and rotates it about the pin 173, against the opposing force of the compression spring 176, thereby providing a means of moving the rocker arm 166 to the unclamped mode. Subsequent deactivation of the extensible cylinder 184 disengages the cam 188 engagement surface from the rocker arm 166 and permits the rocker arm 166 to return to the normally biased clamped mode.

The sheet material is thus moved during processing by the sheet material clamp assembly 139 which provides a means for gripping the sheet material. The sheet material clamp assembly 139, or gripping means, is moved to various determined positions by the sheet material positioning assembly. The sheet material positioning assembly includes the x-axis frame assembly 100 that is positioned within the x-axis plane to determined positions in response to the motor 130 in communicating relationship with the belt 124, thereby providing a means for displacing the x-axis frame assembly 100. The sheet material positioning assembly furthermore has the y-axis positioning assembly having the y-axis sheet material support table 133 that slidably supports the sheet material clamp assembly 139 (gripping means). The sheet material clamp assembly 139 is positioned within the y-axis plane to determined positions in response to the motor 140 in communicating relationship with the belt 142, thus providing a means for displacing the gripping means to determined positions along the y-axis. The x-axis frame assembly 100 and the sheet material clamp assembly 139 therefore cooperatively position the sheet material within determined positions in the x-axis plane and the y-axis plane, or in other words within the two axis x-y plane.

The sheet material is moved to determined positions coinciding with the desired group of tools supported by the tool assembly 148, also sometimes referred to herein as a grouping support assembly. The tool assembly 148, or grouping support assembly, includes the punch magazine 200, the stripper plate 201 and the die block 202 which support the plurality of conventional punches 206, stripper dies 226 and dies 234, respectively. The stripper plate is supported by the punch magazine 200 which, in turn, is supported by the magazine support frame 18. The die block 202 is supported by the die lifter block 273 in the operable mode, and alternatively supported by the bolster frame 16 in the recessed mode. The punch magazine 200 and depending stripper plate 201 are removable from the magazine support frame 18 to provide the removal of a group of punches 206 and stripper dies 226. Likewise, die block 202 is removable from the die lifter block 273 to provide the removal of a group of dies 234.

As the sheet material is positioned adjacent the desired tool assembly 148, the punching head assembly 374 operably positions the punch cylinder 413 adjacent the desired tool assembly 148. The punching head assembly 374 is supported by the x-axis frame assembly 100 and is positioned in response to motor 522 and gear 524 in communicating engagement with the gear rack 520, thus providing a means for positioning the punch head.

Once the sheet material, tool assembly 148, and punching head assembly 374 are aligned, the selector assembly 416 provides a means for transmitting the punching force of the punch cylinder 413 to the selected punches 206 within the desired tool assembly 148. The selector assembly 416 includes the selector member 418 that is rotatably supported within the selector frame 420. The selector member pulley 438, depending from the selector member 418, engages the first belt 450 and is thereby rotated in response to the motor 442 in cooperation with the first clutch 448, providing a means for rotating the selector member 418 to selectively position one of a plurality of faces, e.g. 426, 428, 430, operably adjacent the plurality of punches 206 in the tool assembly 148. The faces, e.g. 426, 428, 430, form characteristic detent portions, e.g. 432, 434, 436, which clearingly prevent engagement of the selector member 418 against a nonselected punch 206. The selector frame 420 is linearly displaced along the ram member 407 to position the selector member 418 adjacent the selected punches 206 in the tool assembly 148. The second belt 472 is attached to the selector frame 420 which is thereby positioned in response to the motor 442 in cooperation with the second clutch 470, thus providing a means for displacing the selector frame 420.

The stripper plate assembly supports the material during punching operations in the same manner as a class A die. The stripper plate assembly includes the stripper plate 201 which supports the plurality of stripper dies 226 in abutting engagement against the sheet material and in coextensive relation to the mating dies 234 in the die block 202. One skilled in the art will recognize this abutting engagement of the stripper plate assembly provides a means for stripping the sheet material during punch 206 withdrawal to prevent undesired distortion in the sheet material. The stripper plate 201 is supported by a number of shoulder bolts 216 which slidingly pass through clearance apertures 218 formed in the stripper plate 201 and which threadingly engage the punch magazine 200 at a distal end. A plurality of stripper springs 222 are compressingly disposed between the punch magazine 200 and the stripper plate 201, as a means for biasing the stripper plate 201 to an extended and parallel attitude with respect to the punch magazine 200.

The die block lifting assembly moves the desired die block 202 from the recessed mode to the operable mode as a means to support the die block 202 against the bottom surface of the sheet material during processing. The die block lifting assembly includes the die block lifter assembly 278 and the frame assembly 279. The frame assembly 279 is positioned along the x-axis plane in response to motor 330 in communicating relationship with the belt 335. This provides a means to position the frame assembly 279 which, in turn, positions the die block lifter assembly 278 below the desired die block 202.

The link belt assembly 341, or link belt means, cooperates with the sheet material support table 133 as a means to support the sheet material as it is moved to determined positions. The link belt assembly 341 is positioned along the x-axis above the recessed die blocks 202 in unison with the die block lifter assembly 278, in response to the motor 336 and belt 342. The link belt assembly 341 furthermore includes the cylinder 349 which, when extended, separates a portion of the link belt assembly 341, thus creating the opening through which the desired die block 202 is operably raised by the die block lifter assembly 278.

Rotary positionable tool assemblies are provided for indexing the punch and die about the z-axis which is transverse to the x-y plane. The indexing braking tool assembly 148A has the indexing braking magazine assembly 250 supporting the encoder 254 and motor 260 which cooperatively position the forming punch 270 as a means to rotate the forming punch 270 about the z-axis. The indexing braking tool assembly 148A furthermore has the indexing die block assembly 252 which supports the encoder 262 and motor 268 that cooperatively position the forming die 272, as a means for rotating the forming die 272 about the z-axis. The indexing punching tool assembly 148B has the indexing punching magazine 530 which supports rotatable punches 206B that are positioned in response to the encoder motor 548 and belt 553, thus providing a means for rotation about the z-axis. The indexing punching tool assembly 148B furthermore has the indexing die block assembly 532 which supports rotatable punching dies 234B that are positioned in response to the encoder motor 564 and belt 570, thus providing a means for rotation about the z-axis.

The sheet material support table furthermore has the sheet material unloading assembly which provides a means for unloading the sheet material from the unclamped sheet material clamp assembly 139 after processing is complete. The sheet material unloading assembly includes the unloader belts 149A which are supported by first and second roller assemblies. The first roller assembly includes the powered inboard shaft 151 which is responsive to motor 152 as a means for rotating the first roller assembly. Rotation of the roller assembly drives the unloader belts 149A as a means to convey a processed sheet material part to remove it from the press assembly.

What is claimed:

1. A press assembly for punching and forming operations on sheet material, comprising:

a central frame;

sheet material positioning means supported by the central frame for positioning the sheet material to determined positions within an x-y axis plane of travel;

a punch head supported by the sheet material positioning means for imparting a punching force, the punch head thereby positionable with respect to the central frame by movement of the sheet material positioning means;

grouping support means for groupingly supporting a plurality of processing tools;

punch head positioning means supported by the sheet material positioning means for operably positioning the punch head adjacent the grouping support means; and transmitting means supported by the punch head and operably interposed between the punch head and the processing tools for selectively transmitting the punching force of the punch head to one or more processing tools, wherein the punching force can be transmitted simultaneously to adjacent processing tools within the grouping support means, where in the punching force can be transmitted simultaneously to non-adjacent processing tools within the grouping support means, and wherein the punching force can be transmitted individually to each of the plurality of processing tools within the grouping support means.

2. The press assembly of claim 1 wherein the sheet material positioning means comprises:

an x-axis frame assembly slidably supported by the central frame for movement along an x-axis direction of travel;

x-frame assembly displacement means for displacing the x-axis frame assembly to determined positions along the x-axis direction of travel;

a y-axis table transversely supported by the x-axis frame assembly;

gripping means slidably supported on the y-axis table for gripping the sheet material; and gripping displacement means for displacing the gripping means to determined positions along the y-axis table.

3. The press assembly of claim 2 wherein the grouping support means comprises:

a punch magazine operably supported by the punch head;

stripping means depending from the punch magazine for stripping the sheet material from the processing tool; and a die block matingly aligned with the punch magazine.

4. The press assembly of claim 3 wherein the punch head positioning means comprises:

a gear rack supported by the x-axis frame assembly; and a motor having an output shaft and gear engaging the gear rack.

5. The press assembly of claim 4 wherein the transmitting means comprises:

a selector frame operably supported by the punch head;

a selector member rotatably supported by the selector frame and having a plurality of characteristic faces, each face having at least one contact surface;

selector frame displacement means for displacing the selector frame to operably position the selector member adjacent a selected processing tool; and selector member rotating means for rotating the selector member to operably position a characteristic face adjacent the selected process tool.

6. The press assembly of claim 5 wherein the stripping means comprises:

a stripper plate supported by the punch magazine;

stripper plate biasing means for biasing the stripper plate spatially parallel to the punch magazine; and a stripper supported by the stripper plate.

7. The press assembly of claim 6 wherein the die block is operably supported by a die block lifting means, the die block lifting means comprising:

a lifting frame slidably supported by the central frame;

a lifting block supported by the lifting frame;

frame positioning means for positioning the lifting frame beneath a desired die block;

a first cylinder supported by the lifting frame;

an opposed second cylinder supported by the lifting frame and having an extensible shaft;

a first wedge member connected to the first cylinder;

a second wedge member connected to the second cylinder, wherein extension of the cylinders engages the wedge members against the lifting block to raise the lifting block in support of the die block.

8. The press assembly of claim 7 wherein the sheet material positioning means further comprises:

unloading means for unloading the sheet material from the gripping means.

9. The press assembly of claim 8 wherein the unloading means comprises:

a first roller supported by the y-axis table;

means for rotating the first roller;

an opposed free wheeling roller; and means supported by the first and second rollers for conveying the sheet material from the press assembly.

10. The press assembly of claim 9 wherein the grouping support means further comprises:

punch rotating means supported by the punch magazine for rotating the processing tool about a z-axis transverse to the x-y plane; and die rotating means supported by the die block for rotating the die about the z-axis.

11. The press assembly of claim 10 further comprising link belt means slidingly supported by the central frame assembly for supporting the sheet material above the die blocks.

12. The press assembly of claim 11 wherein the gripping means comprises:

a clamp frame supported by the y-axis table;

a rocker arm pivotally supported by the clamp frame which clamps the sheet material in a clamped position and which unclamps the sheet material in an unclamped position;

rocker arm biasing means supported by the clamp frame for biasing the rocker arm to the clamped position;

rocker arm moving means supported by the clamp frame for moving the rocker arm to the unclamped position; and displacement means for displacing the clamp frame.

13. The press assembly of claim 12 wherein the rocker arm moving means comprises:

a cam having an extended position and a retracted position, wherein the cam operably engages the rocker arm in the extended position to pivot the rocker arm to the unclamped position, and wherein the cam operably disengages the rocker arm in the retracted position; and cam displacing means for displacing the cam between the extended position and the retracted position.

* * * * *